US009822581B2

(12) United States Patent
Clarahan

(10) Patent No.: US 9,822,581 B2
(45) Date of Patent: Nov. 21, 2017

(54) PRESSURE COMPENSATED GLASS UNIT

(71) Applicant: LITEZONE TECHNOLOGIES INC., Edmonton (CA)

(72) Inventor: Gregory L. Clarahan, Edmonton (CA)

(73) Assignee: LITEZONE TECHNOLOGIES INC., Edmonton (CA)

( * ) Notice: Subject to any disclaimer, the term of this patent is extended or adjusted under 35 U.S.C. 154(b) by 0 days.

(21) Appl. No.: 14/905,150

(22) PCT Filed: Jul. 18, 2014

(86) PCT No.: PCT/CA2014/000598
§ 371 (c)(1),
(2) Date: Jan. 14, 2016

(87) PCT Pub. No.: WO2015/006862
PCT Pub. Date: Jan. 22, 2015

(65) Prior Publication Data

US 2016/0168902 A1 Jun. 16, 2016

(30) Foreign Application Priority Data

Jul. 19, 2013 (WO) ..... PCT/CA2013/000653

(51) Int. Cl.
*E06B 3/677* (2006.01)
*E06B 3/663* (2006.01)
(Continued)

(52) U.S. Cl.
CPC ..... *E06B 3/677* (2013.01); *E06B 3/66347* (2013.01); *E06B 3/66361* (2013.01);
(Continued)

(58) Field of Classification Search
CPC .... E06B 3/66366; E06B 3/6715; E06B 3/677; E06B 3/66361; E06B 2003/6638;
(Continued)

(56) References Cited

U.S. PATENT DOCUMENTS 2,597,097 A 5/1952 Haven
2,838,809 A 6/1958 Zeolla et al.
(Continued)

FOREIGN PATENT DOCUMENTS

CA 2555217 A1 5/2004
CA 2477781 A1 11/2004
(Continued)

*Primary Examiner* — Adriana Figueroa
*Assistant Examiner* — Jessie Fonseca
(74) *Attorney, Agent, or Firm* — Terrence N. Nuharchuk; Rodman & Rodman LLP

(57) ABSTRACT

A glass unit including a spacer, a front glass pane attached to a front side of the spacer, a back glass pane attached to a back side of the spacer, and a pressure equalization conduit defined by and within the spacer, wherein the pressure equalization conduit has a first end and a second end, wherein the pressure equalization conduit contains a desiccant and is in fluid communication with an exterior of the glass unit at a first end port adjacent to the first end and with an interior space of the glass unit at a second end port adjacent to the second end. The glass unit may further include one or more intermediate layers contained within the interior space and one or more floating suspension systems for supporting the intermediate layers.

68 Claims, 16 Drawing Sheets

(51) Int. Cl.
*E06B 3/67* (2006.01)
*E06B 7/02* (2006.01)
*E06B 7/12* (2006.01)
*E06B 7/14* (2006.01)

(52) U.S. Cl.
CPC ..... *E06B 3/66366* (2013.01); *E06B 3/6715* (2013.01); *E06B 7/02* (2013.01); *E06B 7/12* (2013.01); *E06B 7/14* (2013.01); *E06B 2003/6638* (2013.01); *E06B 2003/66395* (2013.01)

(58) Field of Classification Search
CPC ..... E06B 3/66342; E06B 3/66; E06B 3/667; E06B 3/24; E06B 3/6612; E06B 7/12; F26B 21/083
See application file for complete search history.

(56) References Cited

U.S. PATENT DOCUMENTS 4,242,386 A * 12/1980 Weinlich ..... E06B 3/6707 156/109
4,334,398 A 6/1982 Grether
4,335,166 A * 6/1982 Lizardo ..... E06B 3/6715 156/107
4,368,226 A * 1/1983 Mucaria ..... B32B 17/10055 428/122
4,432,174 A * 2/1984 Grether ..... E06B 3/6715 156/109
4,455,796 A 6/1984 Schoofs
4,536,424 A * 8/1985 Laurent ..... E06B 3/6715 156/107
4,542,611 A 9/1985 Day
4,563,843 A 1/1986 Grether et al.
4,604,840 A * 8/1986 Mondon ..... E06B 1/6015 52/172
4,613,530 A * 9/1986 Hood ..... E06B 3/6715 174/360
4,674,243 A 6/1987 Schoofs
4,786,539 A 11/1988 Grether
4,835,926 A 6/1989 King
5,007,217 A * 4/1991 Glover ..... E06B 3/66328 428/34
5,156,894 A * 10/1992 Hood ..... E04C 2/54 156/109
5,237,787 A 8/1993 Grether et al.
5,260,112 A 11/1993 Grether et al.
6,115,989 A * 9/2000 Boone ..... E06B 3/66366 52/204.61
6,289,641 B1 * 9/2001 McCandless ..... E06B 3/66366 52/172
7,571,583 B2 8/2009 Winfield
8,112,860 B2 2/2012 Collins
2001/0015037 A1 * 8/2001 Thompson, Jr. .... E06B 3/66366 52/172
2005/0034386 A1 * 2/2005 Crandell ..... E06B 3/24 52/204.5
2006/0260228 A1 * 11/2006 Winfield ..... E06B 3/66319 52/204.593
2007/0261358 A1 * 11/2007 Davis ..... E06B 3/24 52/658
2012/0017524 A1 1/2012 Milburn et al.
2012/0141699 A1 * 6/2012 Mader ..... E06B 3/66366 428/34
2013/0260062 A1 * 10/2013 Kleinhempel ..... E06B 3/6715 428/34
2014/0290156 A1 * 10/2014 Bruce ..... E06B 3/677 52/171.3

FOREIGN PATENT DOCUMENTS

| | | |
|---|---|---|
| CA | 2507108 | 5/2010 |
| CA | 2551356 | 12/2013 |
| CN | 1867749 | 11/2006 |
| CN | 100547219 | 10/2009 |
| EP | 2003260 A2 | 12/2008 |
| WO | WO 2004/051045 | 6/2004 |

* cited by examiner

PRESSURE COMPENSATED GLASS UNIT

TECHNICAL FIELD

A pressure compensated glass unit which includes a desiccant for providing relatively dry air within the interior space of the glass unit and which is scalable to provide a desired amount of thermal resistance of the glass unit.

BACKGROUND OF THE INVENTION

A complete window typically includes a glass unit and a window frame.

A glass unit typically includes a pair of glass panes and a spacer, wherein the pair of glass panes is separated and held in a spaced-apart parallel relationship by the spacer, thereby defining an interior space within the glass unit.

A glass unit may also include one or more intermediate layers within the interior space, between the pair of glass panes. The intermediate layers may be constructed of film, glass or some other suitable material. A purpose of the intermediate layers is to increase the thermal resistance of the glass unit. The thermal resistance of a glass unit generally increases with the number of intermediate layers which are included in the glass unit.

A glass unit is typically mounted within a window frame in order to provide a complete window, and a complete window is typically installed in a wall or opening in a building.

A glass unit may be a sealed glass unit or a pressure compensated (i.e., "open") glass unit.

A sealed glass unit can prevent moisture from entering the interior space within the glass unit as long as the integrity of the seal or seals is maintained. The interior space of a sealed glass unit can also be filled with a gas which has a relatively high thermal resistance (such as argon, krypton or xenon) in order to further increase the thermal resistance of the glass unit. Unfortunately, the components of a sealed glass unit (such as the glass panes, intermediate layers, and seals) can be exposed to significant stresses due to temperature and pressure fluctuations which may occur within the interior space of the glass unit during the installation life of the glass unit.

A pressure compensated glass unit can mitigate the extent to which the components of the glass unit are exposed to stresses due to temperature and pressure fluctuations, but a pressure compensated glass unit can introduce moisture into the interior space of the glass unit because the interior space communicates with the exterior of the glass unit in order to transfer air between the interior space of the glass unit and the exterior of the glass unit, and because the air at the exterior of the glass unit invariably contains some amount of ambient moisture.

In both a sealed glass unit and a pressure compensated glass unit, a desiccant can be used to reduce the amount of moisture present within the interior space of the glass unit, in order to provide relatively dry gas within the interior space.

In a sealed glass unit, the desiccant may be contained within one or more desiccant chambers which are in fluid communication with the interior space of the glass unit, so that residual moisture can be removed from the gas which is sealed within the interior space of the glass unit.

In a pressure compensated glass unit, the desiccant may be contained within one or more desiccant chambers which are in fluid communication with both the interior space of the glass unit and the exterior of the glass unit, so that air which is transferred from the exterior of the glass unit to the interior space is stripped of moisture before entering the interior space.

The one or more desiccant chambers may be incorporated into the spacer of the glass unit, and/or may be external to the glass unit. A disadvantage of using a desiccant in a glass unit is that the desiccant becomes saturated or spent as it absorbs and/or adsorbs moisture. As a result, the installation life of a glass unit which includes a desiccant may be dependent upon the service life of the desiccant, or the glass unit must facilitate the replacement of the desiccant at the end of its service life.

Examples in the prior art of sealed glass units and pressure compensated glass units which address the reduction of moisture within the interior space and which may also address the thermal resistance of the glass unit include U.S. Pat. No. 4,334,398 (Grether), U.S. Pat. No. 4,563,843 (Grether), U.S. Pat. No. 5,237,787 (Grether et al), U.S. Pat. No. 5,260,112 (Grether et al), U.S. Pat. No. 7,571,583 (Winfield), Canadian Patent No. 2,507,108 (Winfield), and Canadian Patent Application No. 2,551,356 (Clarahan).

There remains a need for a pressure compensated glass unit which can provide relatively dry air within the interior space of the glass unit and which can be adapted to provide a desired amount of thermal resistance of the glass unit.

SUMMARY OF THE INVENTION

References in this document to orientations, to parameters, to ranges, to lower limits of ranges, and to upper limits of ranges are not intended to provide absolute and/or strict boundaries for the scope of the invention, but should be construed to mean "approximately" or "about" or "substantially", within the scope of the teachings of this document, unless expressly stated otherwise.

The present invention is directed at a pressure compensated glass unit.

In some embodiments, the invention is a glass unit comprising a spacer, a pair of glass panes, and a pressure equalization conduit which is in fluid communication with an interior space of the glass unit, which is in fluid communication with the exterior of the glass unit, and which contains a desiccant. In some embodiments, the invention may comprise one or more intermediate layers contained within the interior space of the glass unit. In some embodiments, the invention may comprise one or more floating suspension systems associated with the one or more intermediate layers.

In a first exemplary embodiment, the invention is a glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane; and (d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, and wherein a desiccant is contained within the pressure equalization conduit.

In some embodiments, the pressure equalization conduit may extend within the spacer at least once around the perimeter of the glass unit.

In some embodiments, the pressure equalization conduit may be continuous between the first end port and the second end port so that a fluid can transfer through the pressure equalization conduit between the exterior of the glass unit and the interior space of the glass unit only at the first end port and the second end port.

In some embodiments, the glass unit may be comprised of one or more intermediate layers contained within the interior space of the glass unit and one or more floating suspension systems.

In some embodiments, the one or more floating suspension systems may each be associated with one intermediate layer and the spacer.

In some embodiments, perimeters of the one or more intermediate layers may be supported by the spacer with the one or more floating suspension systems so that the one or more intermediate layers are in a spaced-apart parallel relationship with the front glass pane and the back glass pane.

In some embodiments, the one or more intermediate layers may be supported by the spacer with the one or more floating suspension systems so that the one or more intermediate layers are capable of moving biaxially within the interior space of the glass unit.

As used herein, "capable of moving biaxially" in the context of an intermediate layer means capable of shifting within the interior space of the glass unit in two directions which are perpendicular to each other, in order to accommodate changes in dimension resulting from temperature changes and/or stresses experienced by the intermediate layer.

In a second exemplary aspect, the invention is a glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane; and (d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, wherein the pressure equalization conduit is continuous between the first end port and the second end port so that a fluid can transfer through the pressure equalization conduit between the exterior of the glass unit and the interior space of the glass unit only at the first end port and the second end port, and wherein a desiccant is contained within the pressure equalization conduit.

In a third exemplary aspect, the invention is a glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane;

(d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, and wherein a desiccant is contained within the pressure equalization conduit;

(e) one or more intermediate layers contained within the interior space of the glass unit, wherein each of the one or more intermediate layers has a perimeter; and (f) one or more floating suspension systems, each associated with one intermediate layer and the spacer, wherein the perimeters of the one or more intermediate layers are supported by the spacer with the one or more floating suspension systems so that the one or more intermediate layers are in a spaced-apart parallel relationship with the front glass pane and the back glass pane and so that the one or more intermediate layers are capable of moving biaxially within the interior space of the glass unit.

The front glass pane and the back glass pane may be constructed of any suitable material or combination of materials and may be of any thickness which is suitable for use as a pane in a glass unit and/or a window. In some embodiments, one or both of the glass panes may be treated and/or coated to alter its properties. Suitable coatings may be applied to one or both sides of the glass panes. In some embodiments, one or both sides of one or both of the glass panes may be may be coated with a low-emissivity (i.e., low-e) coating.

The desiccant may consist of, consist essentially of, or be comprised of any suitable material or combination of materials which is capable of absorbing and/or adsorbing moisture. Any amount of the desiccant may be contained within the pressure equalization conduit. In some embodiments, the pressure equalization conduit may be substantially filled with the desiccant.

The pressure equalization conduit may extend for any distance within the spacer. In some embodiments, the pressure equalization conduit may extend within the spacer less than once around the perimeter of the glass unit. In some embodiments, the pressure equalization conduit may extend within the spacer at least once around the perimeter of the glass unit. In some embodiments, the pressure equalization conduit may extend within the spacer more than once around the perimeter of the glass unit. In some embodiments, the pressure equalization conduit may extend within the spacer several times around the perimeter of the glass unit. In general, the performance and service life of the glass unit may increase/improve as the length of the pressure equalization conduit is increased.

In some embodiments, the glass unit may be comprised of one or more desiccant chambers or desiccant conduits in addition to the pressure equalization conduit, wherein the one or more desiccant chambers or desiccant conduits are in fluid communication with at least the interior space of the glass unit, and may be in fluid communication with the exterior of the glass units. Such desiccant chambers or desiccant conduits may provide a supplemental mechanism for removing moisture from within the interior space of the glass unit, and may provide any number of ports for communicating with the interior space of the glass unit.

The spacer may be comprised of any shape which is capable of defining the perimeter of the glass unit. In some particular embodiments, the spacer may be circular so that the perimeter of the glass unit is a circular perimeter. In some particular embodiments, the spacer may be rectangular so that the perimeter of the glass unit is a rectangular perimeter.

The spacer may be configured in any manner to define the perimeter of the glass unit. In some embodiments, the spacer may be comprised of a single spacer member which defines the perimeter of the glass unit.

In some embodiments, the spacer may be comprised of a plurality of spacer members which are connected together to define the perimeter of the glass unit. The spacer members may be connected together in any suitable manner, including as non-limiting examples, by gluing, by welding, by taping, with interlocking complementary features and/or with fasteners such as screws or nails.

In some particular embodiments, the perimeter of the glass unit may be a rectangular perimeter and the spacer may be comprised of spacer side members which are connected together to define the rectangular perimeter of the glass unit. In some embodiments, the spacer side members may be connected together directly in order to define the rectangular perimeter. In some embodiments, the spacer may be further comprised of one or more spacer corner members for connecting the spacer side members together.

In some particular embodiments, the spacer may be comprised of four spacer side members which are connected together to define a rectangular perimeter of the glass unit. In some embodiments, the spacer may be further comprised of four spacer corner members for connecting the spacer side members together.

A spacer member may be configured in any manner. In some embodiments, one or more of the spacer members may be unitary spacer members which are formed from a single piece of material or from a plurality of pieces of material which are permanently connected together. In some embodiments, one or more of the spacer members may be assembled spacer members which are formed from a plurality of pieces of material which are assembled together.

The spacer members may be fabricated in any suitable manner, including as non-limiting examples by molding, extruding, or pultruding.

In some particular embodiments, each of the spacer side members may be a unitary spacer member. In some particular embodiments, each of the spacer corner members may be a unitary spacer member.

The spacer may be constructed of any suitable material or combination of materials. In some embodiments, the spacer may be comprised of one or more materials which have reasonably good thermal insulating properties. In some embodiments, the spacer may be comprised of one or more materials which are reasonably resilient, flexible, and/or strong. In some embodiments, the spacer may be comprised of one or more materials which have a coefficient of expansion which is generally comparable to the coefficient of expansion of the front glass plane and the back glass pane, in order to avoid excessive differential expansion and contraction between the spacer and the glass panes.

In some particular embodiments, each of the spacer members may consist of, consist essentially of, or be comprised of fiberglass, which exhibits many or all of the desirable properties for a spacer material.

The pressure equalization conduit may be configured within the spacer in any manner.

In some embodiments, the spacer may define a channel therein and the channel may provide the pressure equalization conduit.

In some embodiments, the spacer may define a plurality of channels which are connected together in a series configuration, and the plurality of channels may provide the pressure equalization conduit.

In some embodiments, the spacer may be comprised of a crossover section for connecting a plurality of channels together in a series configuration. In some embodiments in which the spacer is comprised of spacer side members and spacer corner members, one of the spacer corner members may be comprised of the crossover section.

The glass unit may be comprised of any number of pressure equalization conduits, as long as at least one of the pressure equalization conduits has a first end and a second end, a first end port adjacent to the first end, and a second end port adjacent to the second end.

In some embodiments, the first end port may be comprised of a single aperture extending between the pressure equalization conduit and the exterior of the glass unit adjacent to the first end of the pressure equalization conduit. In some embodiments, the first end port may be comprised of a plurality of apertures extending between the pressure equalization conduit and the exterior of the glass unit adjacent to the first end of the pressure equalization conduit.

In some embodiments, the second end port may be comprised of a single aperture extending between the pressure equalization conduit and the interior space of the glass unit adjacent to the second end of the pressure equalization conduit. In some embodiments, the second end port may be comprised of a plurality of apertures extending between the pressure equalization conduit and the interior space of the glass unit adjacent to the second end of the pressure equalization conduit.

In some embodiments, the length of the pressure equalization conduit between the first end port and the second end port may be maximized in order to maximize the distance a fluid must travel within the pressure equalization conduit to transfer between the exterior of the glass unit and the interior space of the glass unit.

In some embodiments, the glass unit may be substantially sealed so that a fluid is inhibited from transferring between the exterior of the glass unit and the interior space of the glass unit other than through the pressure equalization conduit.

The glass unit may be sealed in any suitable manner.

In some embodiments, the glass unit may be comprised of a front seal around the perimeter of the glass unit for providing a seal between the spacer and the front glass pane. In some embodiments, the glass unit may be comprised of a back seal around the perimeter of the glass unit for providing a seal between the spacer and the back glass pane.

The front seal and the back seal may be comprised of separate seals or may be comprised of a single seal.

The front seal and the back seal may be comprised of any suitable material or combination of materials. In some embodiments, the front seal and/or the back seal may be comprised of polyurethane, silicone, polysulfide, polyisobutylene and/or some other suitable material. In some embodiments, the front seal and/or the back seal may be formed before they are applied to the glass unit. In some embodiments, the front seal and/or the back seal may be applied to the glass unit in a form which requires setting after the seal or seals have been applied to the glass unit.

In some embodiments, the glass unit may be comprised of one or more spacer seals around the perimeter of the glass unit for providing a seal between spacer members. In embodiments in which one or more of the spacer members are unitary spacer members, the need for spacer seals may be reduced or eliminated.

In some embodiments, the glass unit may be comprised of a sealing material which may be applied to the spacer and/or to the interfaces between the spacer and the glass panes in order to reduce the permeability of the material of the spacer and/or of flaws and imperfections in the glass unit to fluids which might otherwise transfer between the exterior of the glass unit and the interior space of the glass unit (other than through the pressure equalization conduit).

The sealing material may consist of, consist essentially of, or be comprised of any suitable material or combination of materials, and may be applied in any suitable manner. As non-limiting examples, the sealing material may be comprised of a liquid material which may be applied to surfaces of the glass unit as a coating, or a solid material which may be applied to surfaces of the glass unit as a sheet or film barrier.

In some particular embodiments, the sealing material may be a liquid material which may be applied as a coating to surfaces of the spacer such as the front side, the back side, the interior perimeter edge and the exterior perimeter edge, and/or to the perimeter of the glass unit in order to inhibit fluids from entering the interior space of the glass unit other than through the pressure equalization conduit. In some particular embodiments, the sealing material may be a solid material such as a metal foil which may be applied to the perimeter of the glass unit in order to inhibit fluids from entering the interior space of the glass unit other than through the pressure equalization conduit.

In some embodiments, the glass unit may be comprised of one or more intermediate layers, wherein each of the one or more intermediate layers has a perimeter. The glass unit may be comprised of any number of intermediate layers.

The one or more intermediate layers may be constructed of any suitable material or combination of materials. All of the intermediate layers may be constructed of the same material or materials, or some or all of the intermediate layers may be constructed of different materials.

In some embodiments, one or more intermediate layers may be a glass lite which is constructed of a glass material. A glass lite may be constructed of any suitable glass material, may be of any suitable thickness, and may be configured in any suitable manner. In some embodiments, a glass lite may be configured as a vacuum glass lite, in which a vacuum space is formed within the glass lite during its fabrication. In some embodiments, one or both sides of a glass lite may be treated or coated with a coating which is suitable for improving the properties of the glass lite, including as a non-limiting example, a low-emissivity (i.e., low-e) coating.

In some embodiments, one or more intermediate layers may be a film layer which is constructed of a film material. A film layer may be constructed of any suitable film material, may be of any suitable thickness, and may be configured in any suitable manner. In some embodiments, one or both sides of a film layer may be treated or coated with a coating which is suitable for improving the properties of the film layer, including as a non-limiting example, a low-emissivity (i.e., low-e) coating.

In some embodiments, the glass unit may be comprised of one or more glass lites and one or more film layers as intermediate layers.

In embodiments of the glass unit which are comprised of one or more intermediate layers, the glass unit may be comprised of one or more floating suspension systems, wherein the perimeters of the intermediate layers are supported by the spacer with the floating suspension systems. In some embodiments, the floating suspension systems may support the intermediate layers within the interior space of the glass unit so that the intermediate layers are in a spaced-apart parallel relationship with the front glass pane and the back glass pane. In some embodiments, the floating suspension systems may support the intermediate layers within the interior space of the glass unit so that the intermediate layers are capable of moving biaxially within the interior space of the glass unit.

In some embodiments, one floating suspension system may be associated with more than one intermediate layer and with the spacer. In some embodiments, one floating suspension system may be associated with one intermediate layer and with the spacer, so that each of the intermediate layers is associated with its own floating suspension system.

A floating suspension system may be comprised of any structure, device or apparatus which is capable of supporting an intermediate layer so that the intermediate layer is in a spaced-apart parallel relationship with the front glass pane and the back glass pane and so that the intermediate layer is capable of moving biaxially within the interior space of the glass unit.

In some embodiments, a floating suspension system may be configured to allow a fluid contained within the interior space of the glass unit to pass around the perimeter of the intermediate layer, thereby providing a substantially equal pressure on both sides of the intermediate layer and allowing for the circulation of the fluid within the interior space of the glass unit.

In some embodiments, a floating suspension system associated with a film layer may be comprised of any structure, device or apparatus which is capable of applying a biaxial tension force to the film layer. In some particular embodiments, a floating suspension system associated with a film layer may be comprised of:

(a) a film bar attached to the film layer around the perimeter of the film layer;
(b) a film slot defined by the spacer around the interior perimeter edge of the spacer, for receiving the film layer therein;
(c) a suspension chamber defined within the spacer around the perimeter of the glass unit, wherein the suspension chamber is in communication with the film slot, for receiving the film bar therein; and
(d) a biasing mechanism for biasing the film bar away from the interior perimeter edge of the spacer.

In such embodiments, the floating suspension system may be configured to allow a fluid contained within the interior space of the glass unit to pass around the perimeter of the film layer by passing through the film slot and the suspension chamber.

The film bar may be comprised of any structure, device or apparatus which is capable of being attached to the film layer and which is sufficiently rigid to provide support to the film layer around its perimeter.

The film bar may be comprised of any number of film bar members which may be arranged around the perimeter of the film layer. In some embodiments, a plurality of film bar members may be arranged around the perimeter of the film layer such that gaps are provided between adjacent film bar members.

As a first non-limiting example, if the glass unit has a rectangular perimeter, the film bar may be comprised of four film bar members (i.e., one film bar member along each side of the rectangle) which are each attached to the film layer. In some such embodiments, gaps may be provided between adjacent film bar members at the corners of the glass unit.

As a second non-limiting example, if the glass unit has a rectangular perimeter, the film bar may be comprised of a plurality of film bar members along each side of the rectangle which are each attached to the film layer. In some such embodiments, gaps may be provided between adjacent film bar members along the sides of the rectangle and/or at the corners of the glass unit.

In embodiments in which the film bar is comprised of a plurality of film bar members, the lengths of the film bar members may be the same or may vary around the perimeter of the film layer.

In embodiments in which gaps are provided between adjacent film bar members, the lengths of the gaps may be the same or may vary around the perimeter of the film layer.

The lengths of the gaps may be less than, equal to, or greater than the lengths of the film bar members.

In some embodiments, a film bar member may be comprised of a pair of members which may be attached to opposing sides of the film layer so that the film layer is interposed between the pair of members.

The film bar may be attached to the film layer in any suitable manner, including, as non-limiting examples, by gluing, by welding, by taping, and/or with fasteners such as screws or nails.

The film slot may be comprised of any gap in the interior perimeter edge of the spacer which is capable of receiving the film layer therein. In some embodiments, the film slot may be sized to allow a fluid to pass through the film slot when the film layer is received within the film slot.

The suspension chamber may be comprised of any space defined within the spacer which is capable of receiving the film bar therein, and which is capable of communicating with the film slot so that the film bar can be received within the suspension chamber when the film bar is attached to the film layer.

The film bar and the suspension chamber may be configured to facilitate the operation of the biasing mechanism in any manner which is compatible with the biasing mechanism. In some embodiments, the film bar may be comprised of a film bar engagement surface, the suspension chamber may be comprised of a chamber engagement surface, and the biasing mechanism may be positioned in the suspension chamber between the film bar engagement surface and the chamber engagement surface.

The biasing mechanism may be comprised of any suitable structure, device or apparatus which is capable of biasing the film bar away from the interior perimeter edge of the spacer when the film bar is received within the suspension chamber.

In some embodiments, the biasing mechanism may be comprised of a plurality of springs arranged within the suspension chamber around the perimeter of the glass unit. The plurality of springs may be comprised of any number of springs. In some embodiments, the biasing mechanism may be comprised of a plurality of pairs of springs, wherein the springs in a pair of springs may be positioned within the suspension chamber on opposite sides of a film layer.

In some embodiments in which the film bar is comprised of a plurality of film bar members, one or more springs or one or more pairs of springs may be associated with each of the film bar members. In some embodiments in which the film bar is comprised of a plurality of film bar members, a single spring or a single pair of springs may be associated with more than one film bar member.

In some embodiments in which the lengths of the film bar members are relatively long, a plurality of springs or a plurality of pairs of springs may be associated with each of the film bar members. In some embodiments in which the lengths of the film bar members are relatively short, a single spring or a single pair of springs may be associated with each of the film bar members so that a separate spring or pair of springs is associated with each of the film bar members.

In some embodiments, a floating suspension system associated with a glass lite may be comprised of any structure, device or apparatus which is capable of allowing the glass lite to expand and contract biaxially within the interior space of the glass lite. In some particular embodiments, a floating suspension system associated with a glass lite may be comprised of a lite pocket defined by the spacer around the interior perimeter edge of the spacer, for receiving the perimeter of the glass lite therein.

In such embodiments, the floating suspension system may be configured to allow a fluid contained within the interior space of the glass unit to pass around the perimeter of the glass lite by passing through the lite pocket.

The lite pocket may be comprised of any recess in the interior perimeter edge of the spacer which is capable of receiving the perimeter of the glass lite therein. In some embodiments, the lite pocket may be sized to allow a fluid to pass through the lite pocket when the glass lite is received within the lite pocket.

In some embodiments, a floating suspension system associated with a glass lite may be further comprised of a biasing mechanism for biasing the perimeter of the glass lite toward the interior perimeter edge of the spacer. In some embodiments, the biasing mechanism may be arranged within the lite pocket around all or a portion of the perimeter of the glass unit so that the glass lite is resiliently supported and cushioned within the lite pocket.

In some embodiments, the biasing mechanism may be arranged only along the bottom of the glass unit, in order to support and cushion the weight of the glass lite. In some embodiments, the biasing mechanism may be arranged only along the bottom and top of the glass unit, in order to support the glass lite and control the vertical position of the glass lite within the glass unit. In some embodiments, the biasing mechanism may be arranged along one or both sides of the glass unit, in order to support the glass lite and control the horizontal position of the glass lite within the glass unit. In some embodiments, the biasing mechanism may be arranged around substantially the entire perimeter of the glass unit in order to support the glass lite and control both the vertical and horizontal position of the glass lite within the glass unit.

In some embodiments, the biasing mechanism may be arranged continuously along the lite pocket. In some embodiments, the biasing mechanism may be arranged intermittently along the lite pocket. In some embodiments, gaps in the biasing mechanism may be provided along the lite pocket. In some embodiments, the biasing mechanism may be comprised of one or more setting blocks, including but not limited to setting blocks of the type which are known for use in the window industry.

In some embodiments, the biasing mechanism may be comprised of a resilient material which is contained within the lite pocket. In some embodiments, the resilient material may be comprised of an elastomeric material which is contained within the lite pocket. In some embodiments, the resilient material may be comprised of a plurality of springs which are contained within the lite pocket.

BRIEF DESCRIPTION OF DRAWINGS

Embodiments of the invention will now be described with reference to the accompanying drawings, in which.

DETAILED DESCRIPTION

The present invention is directed at a pressure compensated glass unit.

Figure 16:
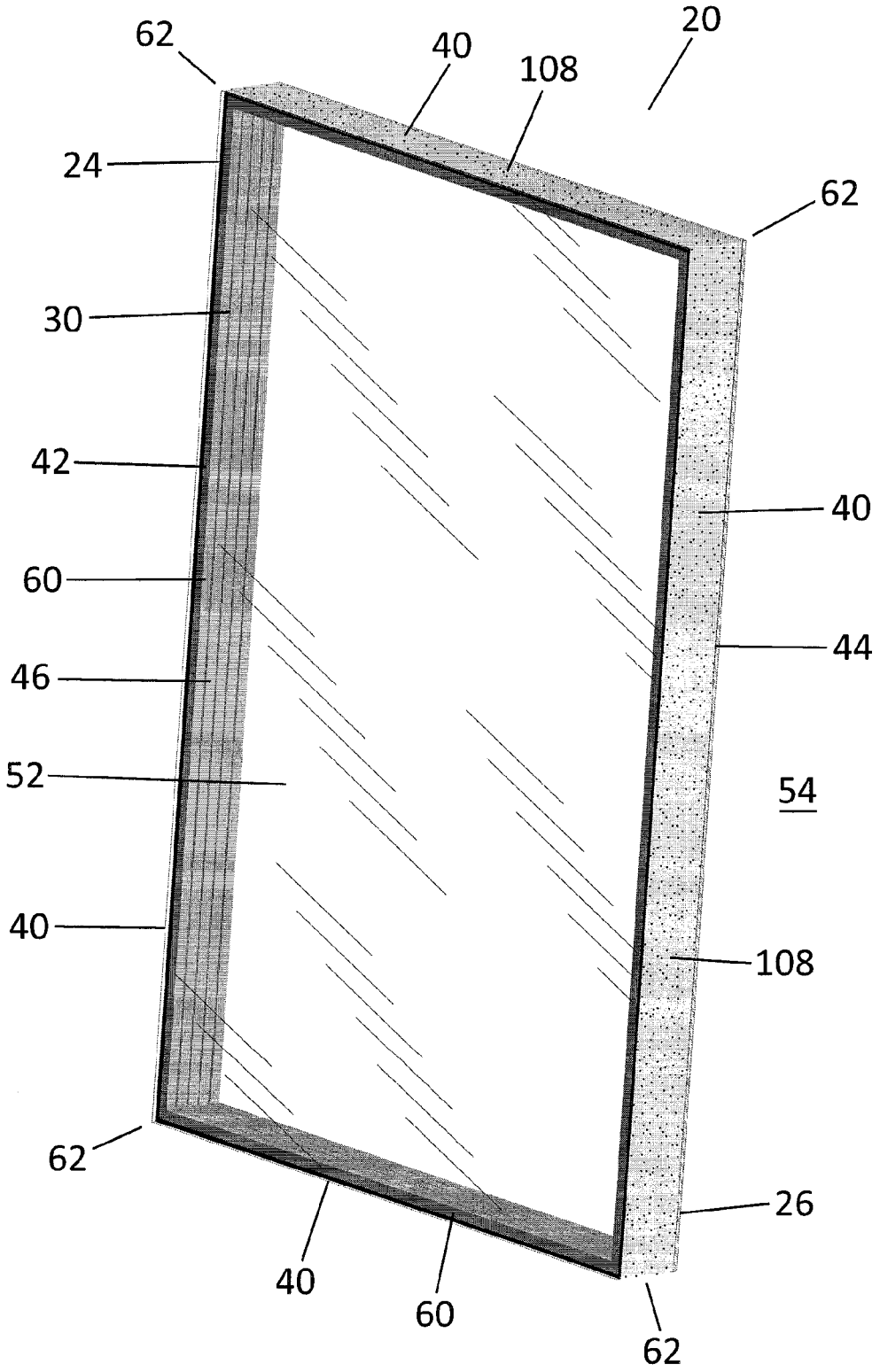
FIG. 16 is a schematic pictorial view of a second exemplary embodiment of a glass unit according to the invention, in which the glass unit comprises a plurality of intermediate glass lites.
Figure 17:
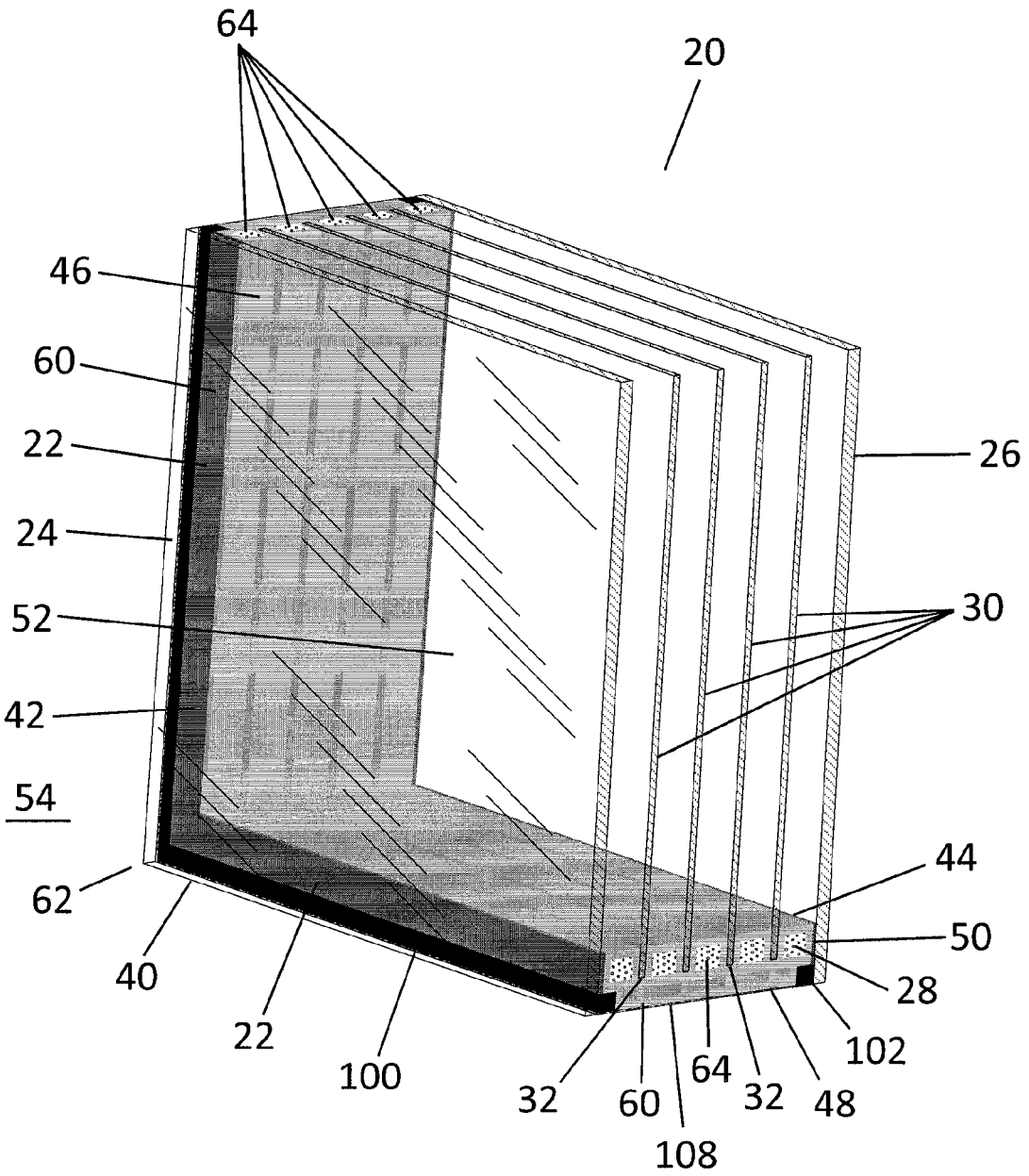
FIG. 17 is a schematic isolated pictorial section view of a corner of the glass unit depicted in FIG. 16.
Figure 18:
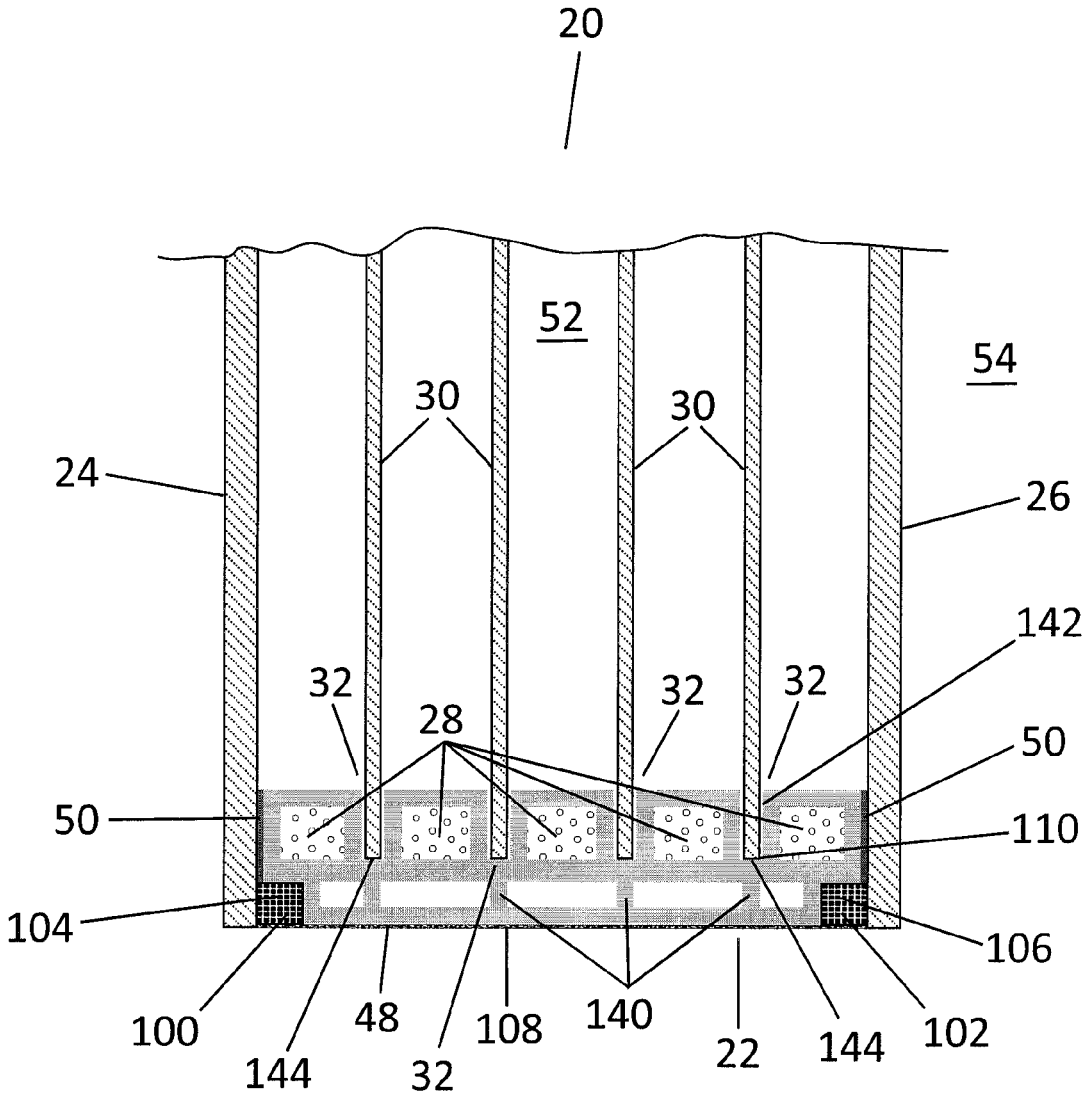
FIG. 18 is a schematic isolated side section view of the glass unit depicted in FIG. 16.

Two exemplary embodiments of the glass unit are depicted in FIGS. 1-18. FIGS. 1-15 depict a first exemplary embodiment of the glass unit in which the glass unit comprises a plurality of intermediate film layers. FIGS. 16-18 depict a second exemplary embodiment of the glass unit in which the glass unit comprises a plurality of intermediate glass lites.

FIGS. 7-15 depict details of an exemplary embodiment of a pressure equalization conduit which is included in the first exemplary embodiment of the glass unit of FIGS. 1-15. The pressure equalization conduit which is included in the second exemplary embodiment of the glass unit of FIGS. 16-18 is very similar to the exemplary embodiment of the pressure equalization conduit which is depicted in FIGS. 7-15.

In the description which follows, features of the second exemplary embodiment of the glass unit which are equivalent to features of the first exemplary embodiment of the glass unit will be described using the same reference numbers.

Figure 1:
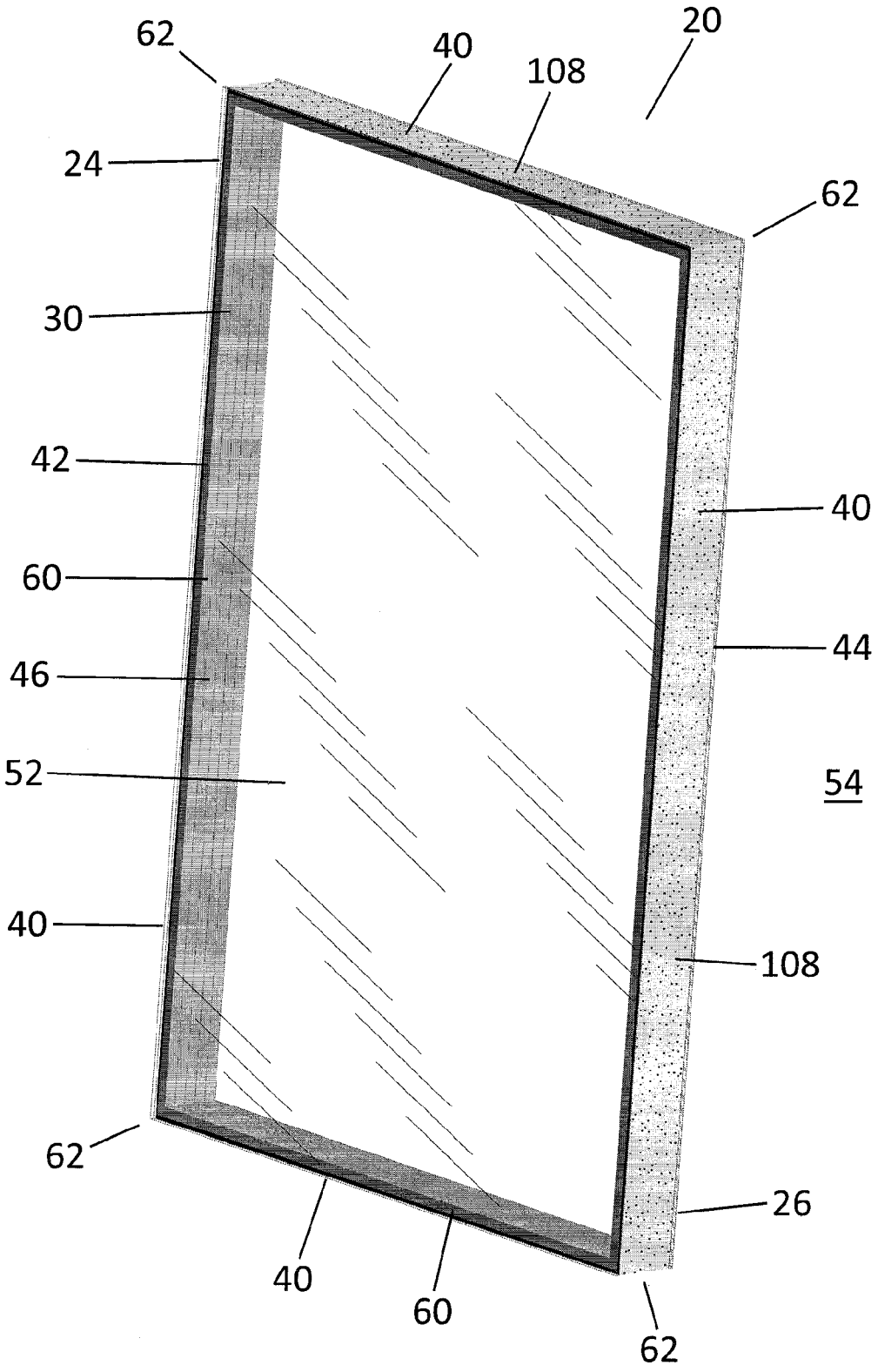
FIG. 1 is a schematic pictorial view of a first exemplary embodiment of a glass unit according to the invention, in which the glass unit comprises a plurality of intermediate film layers.
Figure 2:
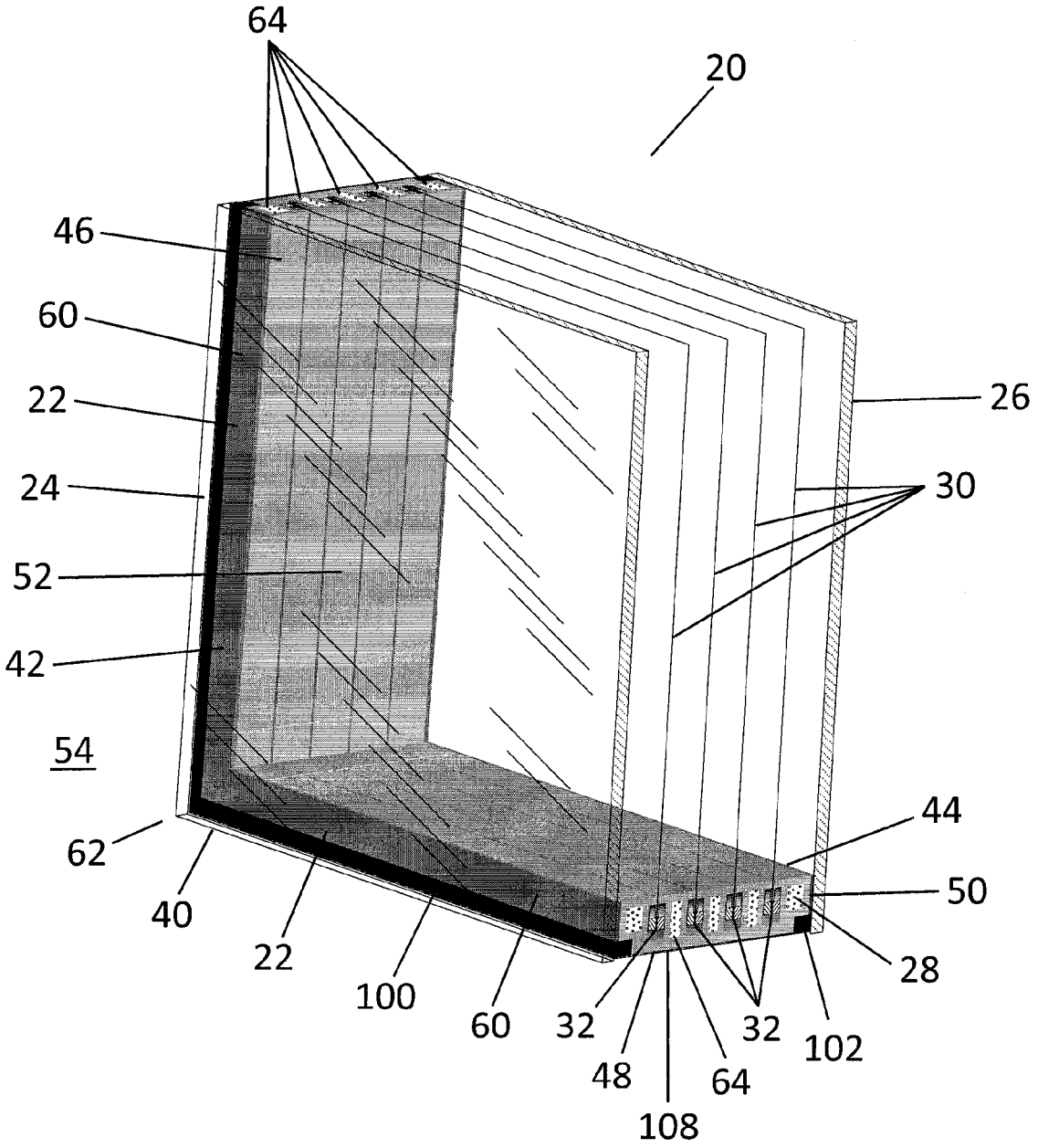
FIG. 2 is a schematic isolated pictorial side section view of a corner of the glass unit depicted in FIG. 1.
Figure 3:
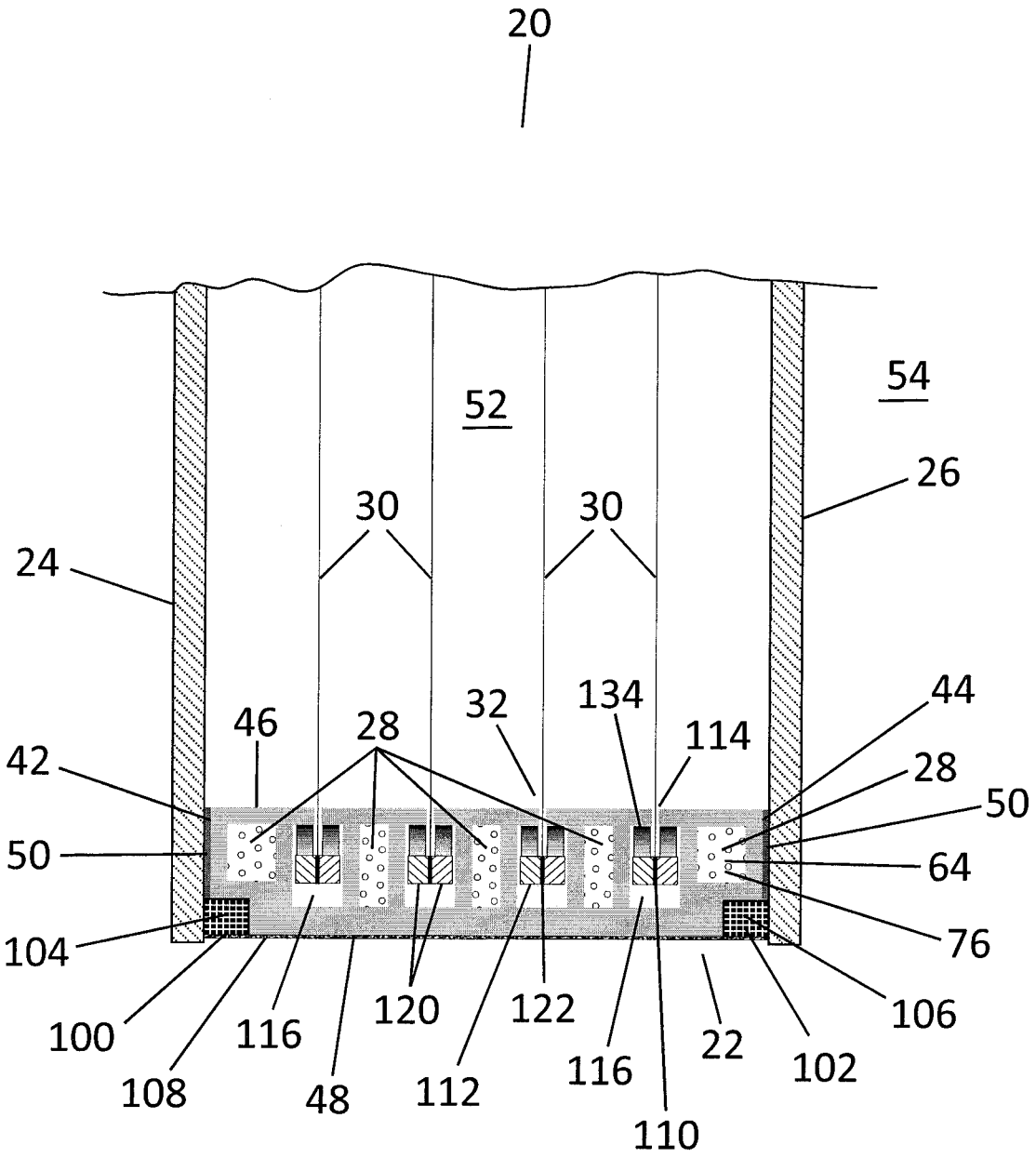
FIG. 3 is a schematic isolated side section view of the glass unit depicted in FIG. 1.

Referring to FIGS. 1-3, the first exemplary embodiment of the glass unit (20) is comprised of a spacer (22), a front glass pane (24), a back glass pane (26), a pressure equalization conduit (28), a plurality of intermediate layers (30), and a plurality of floating suspension systems (32) for the intermediate layers (30).

Referring to FIG. 1, the spacer (22) defines a perimeter (40) of the glass unit (20). Referring to FIG. 3, the spacer (22) has a front side (42), a back side (44), an interior perimeter edge (46) and an exterior perimeter edge (48).

Referring to FIG. 3, the front glass pane (24) is attached to the front side (42) of the spacer (22) with a high bond strength double sided tape (50). In other embodiments, the front glass pane (24) may be attached to the front side (42) of the spacer (22) in a suitable alternate manner.

Referring to FIG. 3, the back glass pane (26) is attached to the back side (44) of the spacer (22) with a high bond strength double sided tape (50). In other embodiments, the back glass pane (26) may be attached to the back side (44) of the spacer (22) in a suitable alternate manner.

Referring to FIGS. 1-3, the front glass pane (24) and the back glass pane (26) are maintained by the spacer (22) in a spaced-apart parallel relationship which defines an interior space (52) of the glass unit (20) between the front glass pane (24) and the back glass pane (26). The exterior perimeter edge (48) of the spacer (22) defines an exterior (54) of the glass unit (20).

Referring to FIG. 1, in the first exemplary embodiment, the perimeter (40) of the glass unit (20) is a rectangular perimeter. In the first exemplary embodiment, the spacer (22) is comprised of four spacer side members (60) which are connected together to define the rectangular perimeter, and four spacer corner members (62) for connecting the spacer side members (60) together.

In other embodiments of the glass unit (20), the spacer side members (60) may be connected together directly so that the spacer corner members (62) can be omitted. In such embodiments, the spacer side members (60) may be provided with mitered corners to facilitate the direct connection of the spacer side members (60).

In the first exemplary embodiment, the spacer side members (60) and the spacer corner members (62) may be connected with each other to provide the assembled spacer (22) by gluing, by welding, by taping, with interlocking complementary features and/or with fasteners such as screws or nails. In some applications, the stability of the connections between the spacer side members (60) and the spacer corner members (62) may be enhanced by using fasteners such as screws or nails at the corners to supplement other means of connection.

Figure 8:
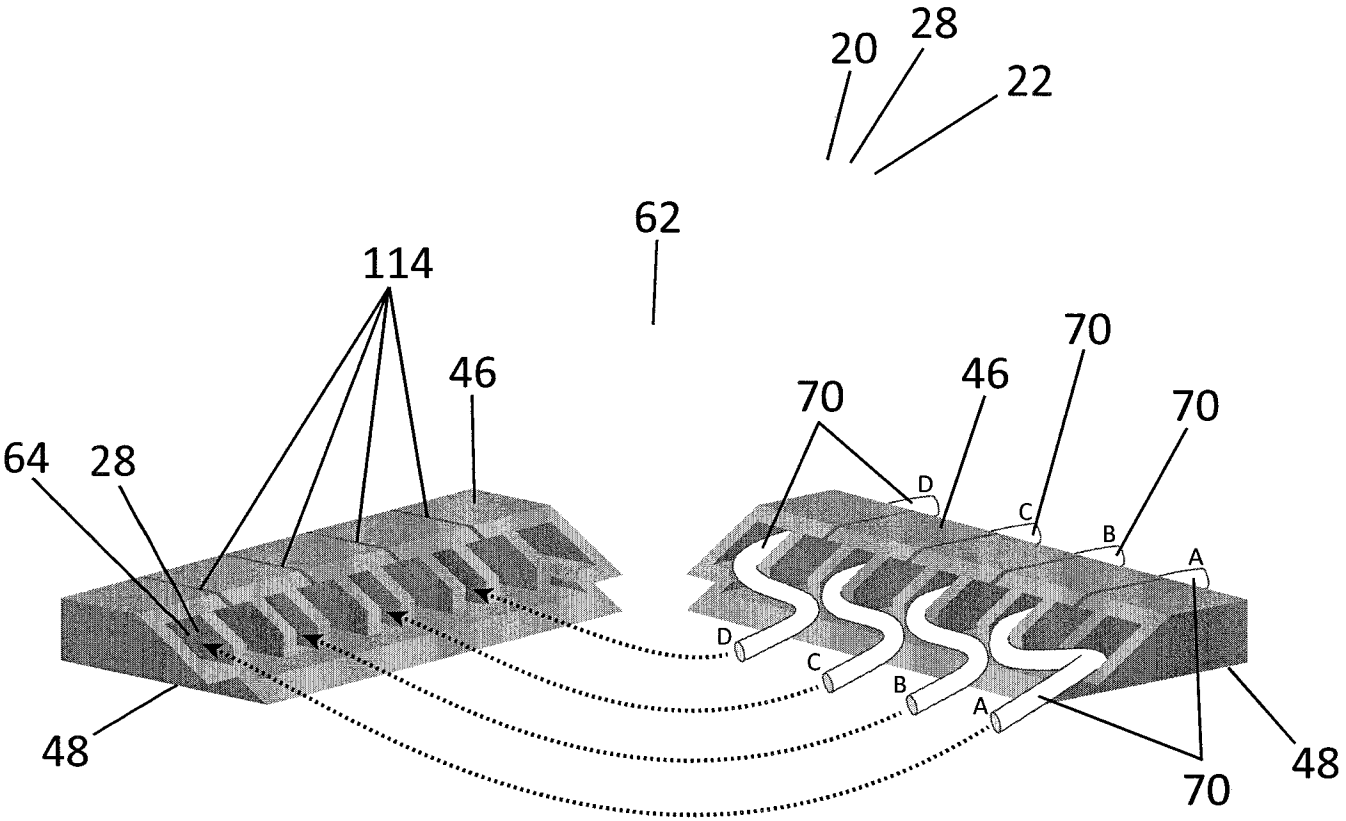
FIG. 8 is a schematic exploded pictorial view of a spacer corner member which provides a crossover section for the spacer at a corner of the glass unit depicted in FIG. 1, showing the crossover of the channels within the spacer.
Figure 9:
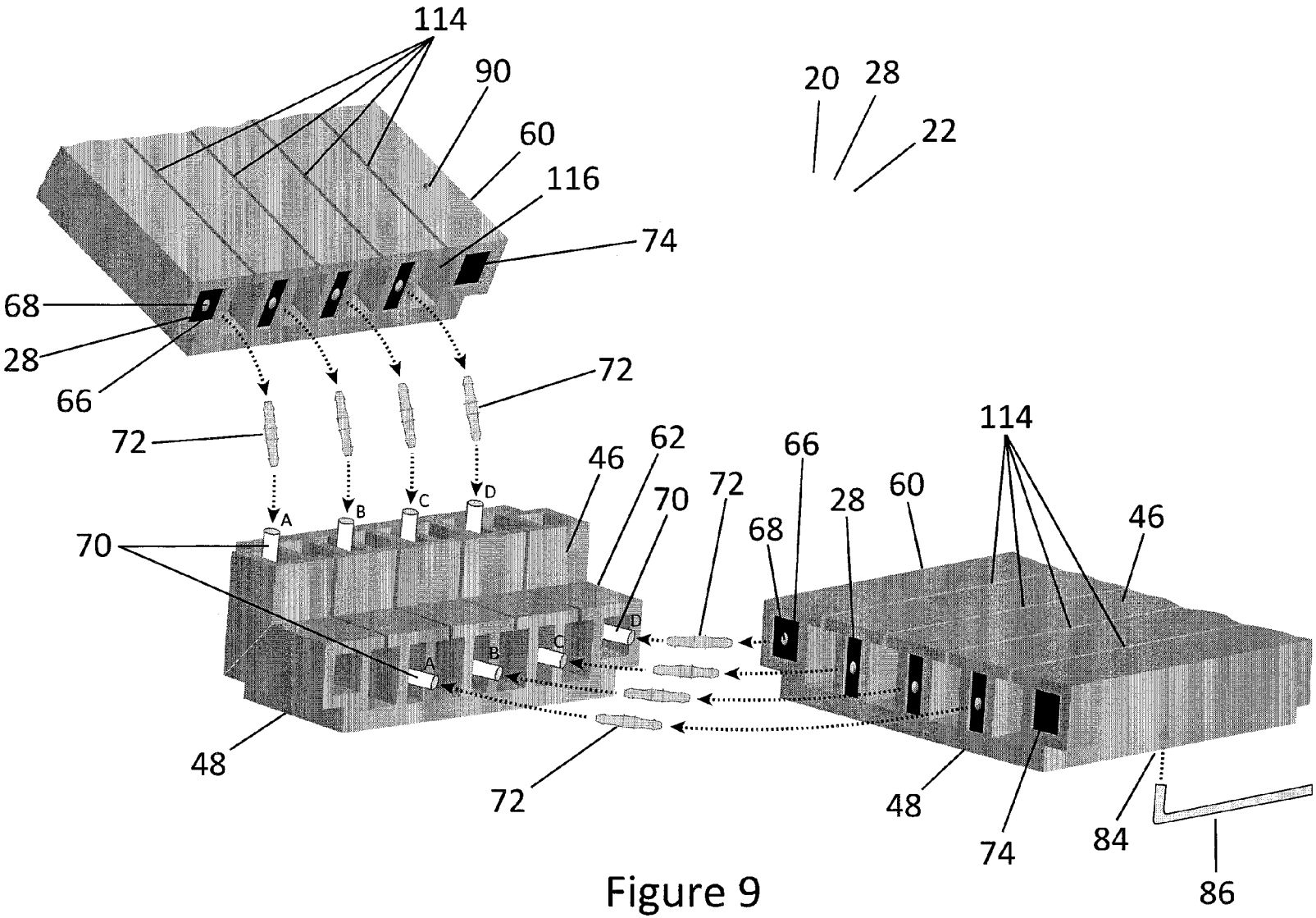
FIG. 9 is a schematic isolated exploded pictorial view of two spacer side members and the spacer corner member depicted in FIG. 8, showing the crossover of the channels within the spacer, the first end of the pressure equalization conduit, and the second end of the pressure equalization conduit.
Figure 12:
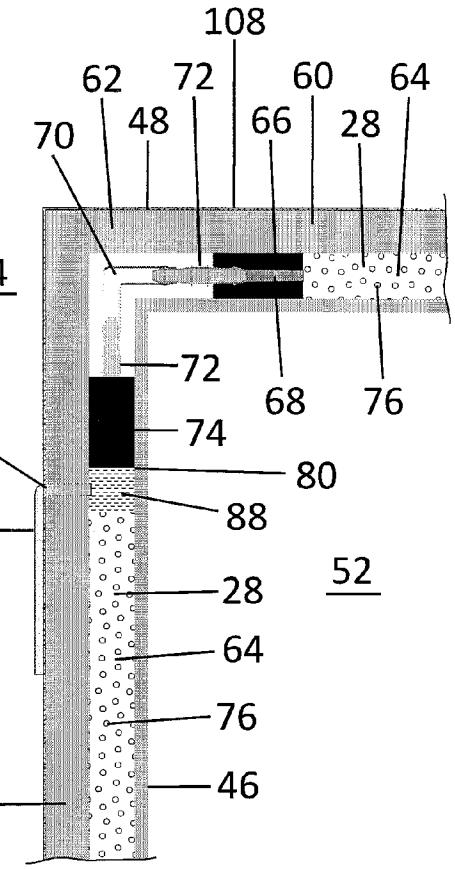
FIG. 12 is a schematic isolated front section view of the corner of the glass unit depicted in FIG. 9 taken along line C-C of FIG. 10, showing the first end of the pressure equalization conduit, the first end port and a portion of the crossover section.
Figure 10:
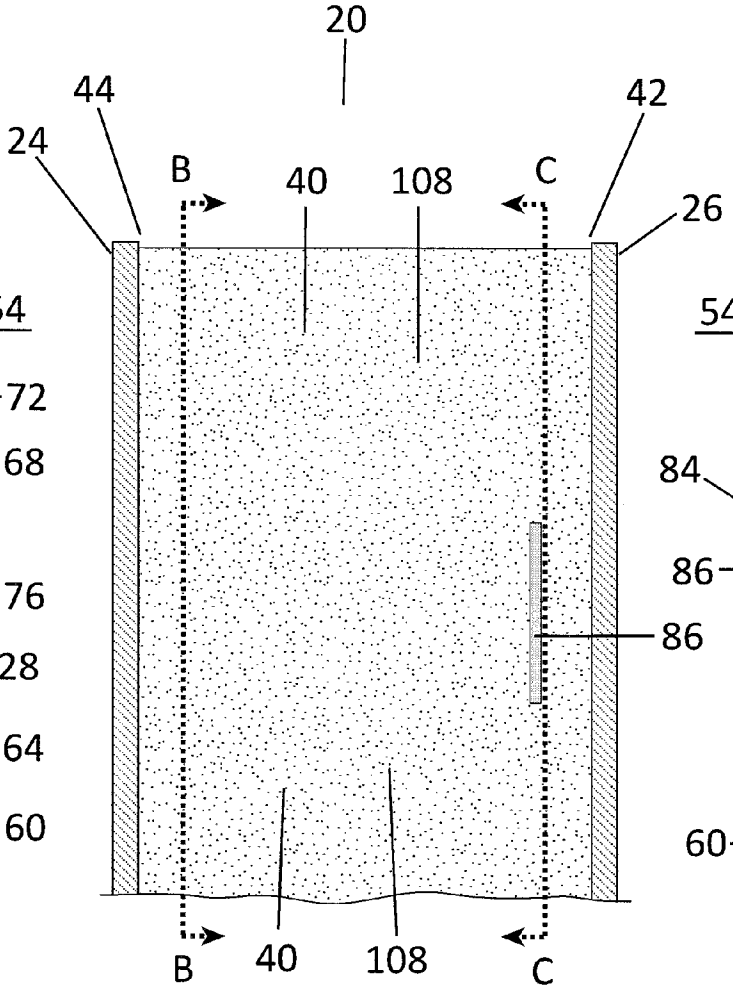
FIG. 10 is a schematic isolated side view of the exterior perimeter edge of the spacer in the glass unit depicted in FIG. 1, at the corner of the glass unit depicted in FIG. 9.
Figure 11:
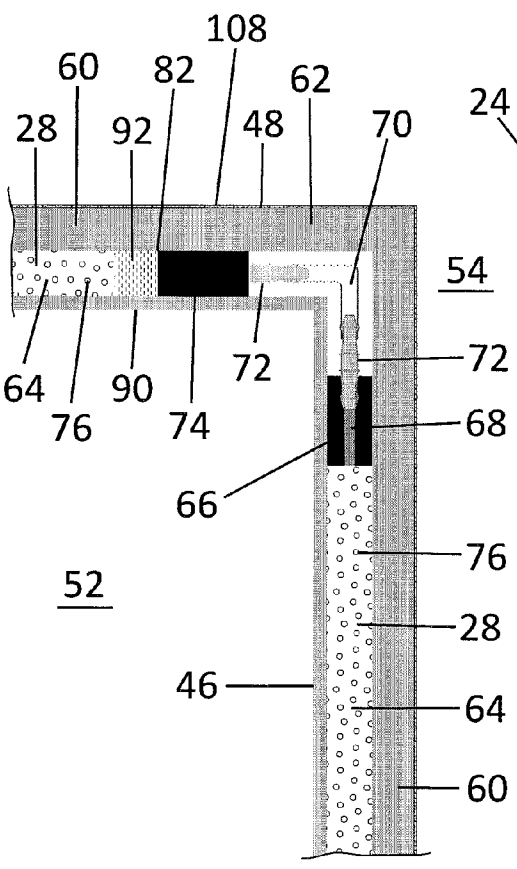
FIG. 11 is a schematic isolated front section view of the corner of the glass unit depicted in FIG. 9 taken along line B-B of FIG. 10, showing the second end of the pressure equalization conduit, the second end port and a portion of the crossover section.
Figure 15:
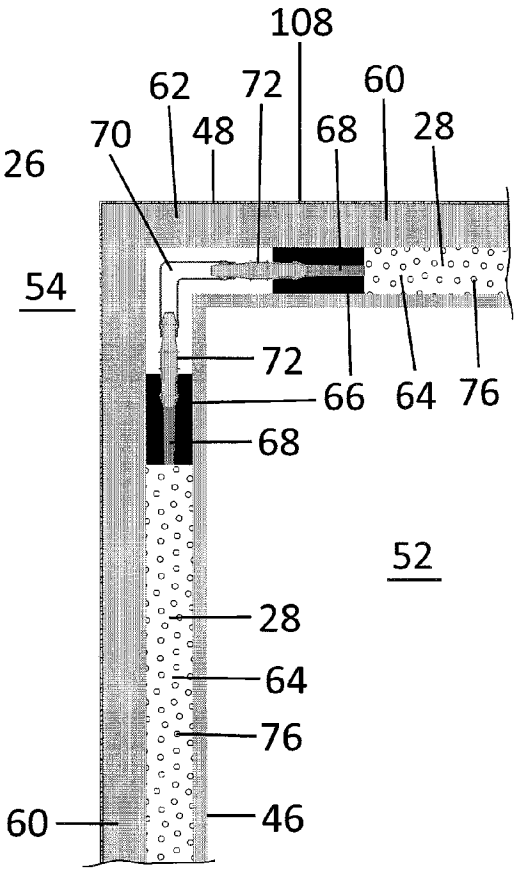
FIG. 15 is a schematic isolated front section view of the corner of the glass unit depicted in FIG. 7 taken along line E-E of FIG. 13, showing the corner interconnection of a channel within the spacer.
Figure 13:
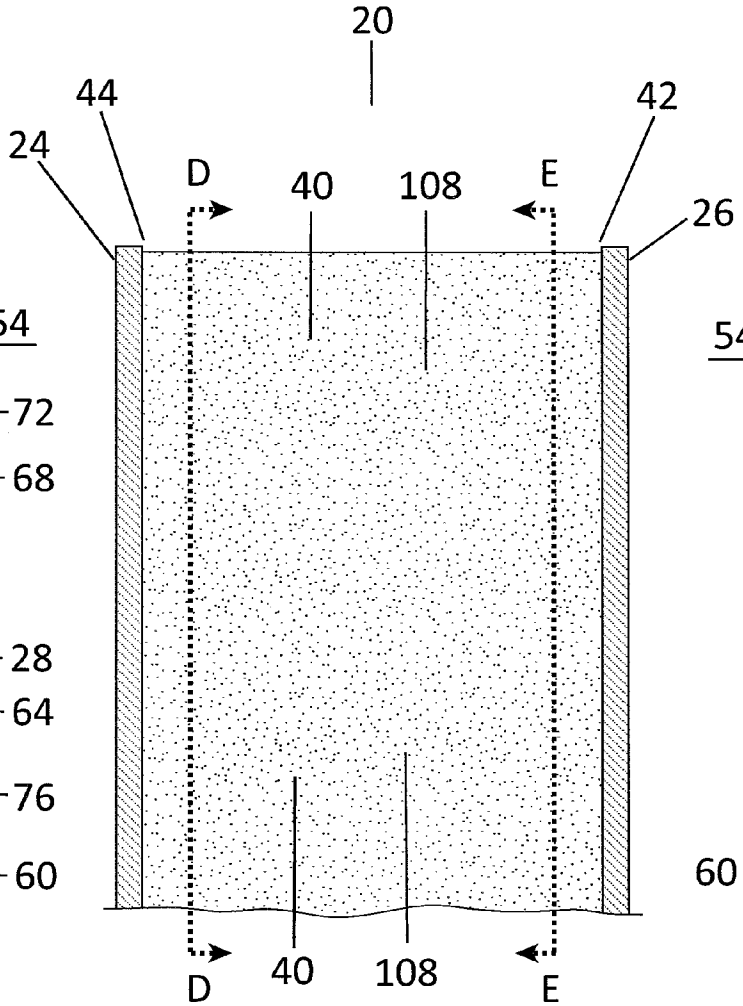
FIG. 13 is a schematic isolated side view of the exterior perimeter edge of the spacer in the glass unit depicted in FIG. 1, at the corner of the glass unit depicted in FIG. 7.
Figure 14:
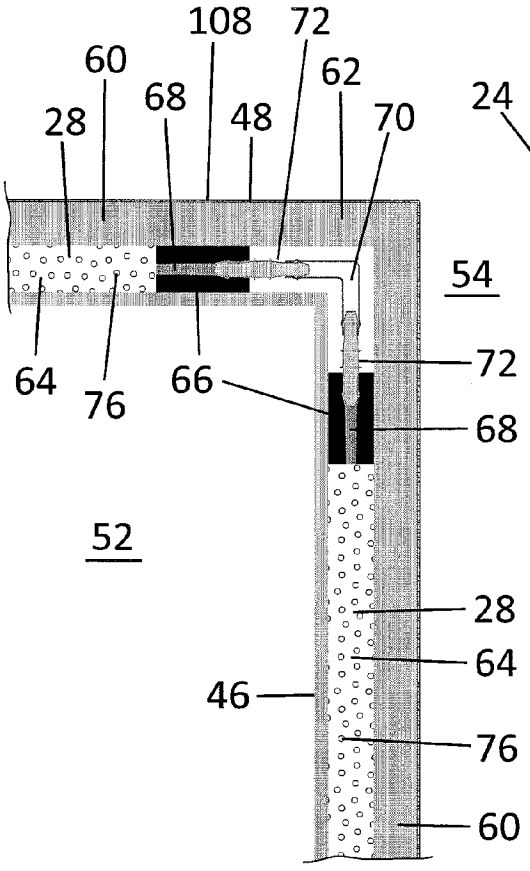
FIG. 14 is a schematic isolated front section view of the corner of the glass unit depicted in FIG. 7 taken along line D-D of FIG. 13, showing the corner interconnection of a channel within the spacer.

In the first exemplary embodiment, the spacer side members (60) and the spacer corner members (62) are constructed of fiberglass, because of the strength, flexibility, thermal resistance and coefficient of expansion properties of fiberglass. In the first exemplary embodiment, the spacer side members (60) are unitary spacer members which are each molded, extruded, pultruded or otherwise formed from a single piece of fiberglass. In the first exemplary embodiment, the spacer corner members (62) may be unitary spacer members which are molded, extruded, pultruded or otherwise formed from a single piece of fiberglass. Alternatively, as depicted in FIGS. 8-9, the spacer corner members (62) may be unitary spacer members which are comprised of two or more pieces of fiberglass permanently connected together.

In the first exemplary embodiment, the assembled spacer (22) defines five parallel channels (64) which extend through the spacer (22) around substantially the entire perimeter (40) of the glass unit (20). In other embodiments, the spacer (22) may define fewer or greater than five channels (64).

In the first exemplary embodiment, some of the five channels (64) have different cross-sectional dimensions to accommodate the positioning of the channels (64) within the spacer (22).

The channels (64) provide the pressure equalization conduit (28). In the first exemplary embodiment, the five channels (64) are connected together in a series configuration so that the pressure equalization conduit (28) extends about five times around the perimeter (40) of the glass unit (20) and has a length which is about five times the length of the perimeter (40) of the glass unit (20).

Referring to FIG. 7 and FIGS. 13-15, three of the spacer corner members (62) provide an interconnection section which connects the five channels (64) with each other so that each of the five channels (64) extends around substantially the entire perimeter (40) of the glass unit (20).

Referring to FIGS. 8-12, the fourth spacer corner member (62) provides a crossover section which connects the five channels (64) in the series configuration so that the five channels are in fluid communication with each other.

The interconnection or crossover of the channels (64) at the spacer corner members (62) may be achieved in any suitable manner. In the first exemplary embodiment, the interconnection or crossover of the channels (64) is achieved using rubber plugs, connectors, and connector tubes.

In other embodiments of the glass unit (20) including, but not limited to embodiments in which the spacer side members (60) are directly connected together and the spacer corner members (62) are omitted, the interconnection and crossover of the channels (64) may be simplified, and may not require the use of such rubber plugs, connectors, connector tubes, or other devices. As a non-limiting example, in some embodiments, a sealant may be used instead of rubber plugs to seal connectors and connector tubes within the channels (64).

Referring again to FIG. 7 and FIGS. 13-15, at the three corners of the perimeter (40) of the glass unit (20) which provide interconnection sections, all five of the channels (64) at the ends of the spacer side members (60) are provided with rubber plugs (66) which define connector holes (68), all five of the channels (64) within the spacer corner members (62) are provided with connector tubes (70), and connectors (72) are provided to connect the connector holes (68) with the connector tubes (70).

Referring again to FIGS. 8-12, at the one corner of the perimeter (40) of the glass unit (20) which provides the crossover section, four of the channels (64) at the ends of the spacer side members (60) are provided with rubber plugs (66) which define connector holes (68), one of the channels (64) at the end of one of the spacer side members (60) is provided with a sealed rubber plug (74) which does not define a connector hole (68), a different channel (64) at the end of the other spacer side member (60) is provided with a sealed rubber plug (74) which does not define a connector hole (68), four of the channels (64) within the spacer corner member (62) are provided with connector tubes (70), and connectors (72) are provided to connect the connector holes (68) with the connector tubes (70).

In the first exemplary embodiment, the pressure equalization conduit (28) is substantially or completely filled with a desiccant (76). In other embodiments, the pressure equalization conduit (28) may be only partly filled with the desiccant (76). The desiccant (76) may be comprised of any suitable material or combination of materials which is capable of absorbing and/or adsorbing moisture.

Referring again to FIGS. 8-12, the pressure equalization conduit (28) has a first end (80) and a second end (82). The ends (80, 82) of the pressure equalization conduit (28) are defined by the two sealed rubber plugs (74) which are provided in the spacer side members (60) at the corner of the perimeter (40) of the glass unit (20) which provides the crossover section.

A first end port (84) is located adjacent to the first end (80) of the pressure equalization conduit (28). The pressure equalization conduit (28) is in fluid communication with the exterior (54) of the glass unit at the first end port (84). In the exemplary embodiment, the first end port (84) is comprised of a single aperture formed in the exterior perimeter edge (48) of the spacer (22). The single aperture extends between the pressure equalization conduit (28) and the exterior (54) of the glass unit (20).

In the exemplary embodiment, a first end port tube (86) is connected with the first end port (84), and a first end port filter (88) is positioned within the pressure equalization conduit (28) at the first end port (84) to prevent particles of the desiccant (76) in the pressure equalization conduit (28) from becoming lodged in and/or plugging the first end port (84) and the first end port tube (86).

The first end port tube (86) may be oriented in a direction which will minimize the risk of liquid entering the first end port tube (86) and/or the first end port (84) from the exterior (54) of the glass unit (20). Optionally, a shingle (not shown) or a similar type of structure or device may be associated with the first end port tube (86) to further inhibit liquid from entering the first end port tube (86) due to capillary action or wicking A second end port (90) is located adjacent to the second end (80) of the pressure equalization conduit (28). The pressure equalization conduit (28) is in fluid communication with the interior space (52) of the glass unit at the second end port (90). In the exemplary embodiment, the second end port (90) is comprised of a single aperture formed in the interior perimeter edge (46) of the spacer (22). The single aperture extends between the pressure equalization conduit (28) and the interior space (52) of the glass unit (20).

In the exemplary embodiment, a second end port filter (92) is positioned within the pressure equalization conduit (28) at the second end port (90) to prevent particles of the desiccant (76) in the pressure equalization conduit (28) from becoming lodged in and/or plugging the second end port (90).

In other embodiments, the second end port (90) may be comprised of a plurality of apertures formed in the interior perimeter edge (46) of the spacer (22) to provide increased fluid communication between the pressure equalization conduit (28) and the interior space (52) of the glass unit (20).

Such increased fluid communication may be desirable to enable residual moisture which remains within the interior space (52) following manufacture of the glass unit (20), or moisture which somehow enters the interior space (52) through flaws or imperfections in the glass unit (20) during its service life, to be removed from the interior space (52) and absorbed and/or adsorbed by the desiccant (76).

Such residual moisture or moisture within the interior space (52) of the glass unit (20) may cause corrosion or other damage to treatments or coatings which may be applied to the intermediate layers (30), the front glass pane (24) and/or the back glass pane (26). Such residual moisture or moisture within the interior space (52) of the glass unit (20) may also condense and thus obscure vision through the glass unit (20), and upon evaporation may leave a residue which also obscures vision through the glass unit (20).

In embodiments in which the second end port (90) may be comprised of a plurality of apertures, all of the apertures are ideally located adjacent to the second end (82) of the pressure equalization conduit (28), in the spacer side member (60) which defines the second end (82) of the pressure equalization conduit (28), and in communication with the channel (64) which contains the sealed rubber plug (74).

Referring again to FIGS. 2-3, in the first exemplary embodiment the glass unit (20) is comprised of a front seal (100) around the perimeter of the glass unit (20) for providing a seal between the spacer (22) and the front glass pane (24), and is comprised of a back seal (102) around the perimeter of the glass unit (20) for providing a seal between the spacer (22) and the back glass pane (26).

The front seal (100) is received within a front seal groove (104) defined in the exterior perimeter edge (48) of the spacer (22), and the back seal (102) is received within a back seal groove (106) defined in the exterior perimeter edge (48) of the spacer (22).

In the first exemplary embodiment, the use of only the front seal (100) and the back seal (102) may be possible because the spacer (22) is comprised of unitary spacer members which themselves may require no sealing.

In other embodiments in which the spacer (22) is not constructed of unitary spacer members, additional spacer seals (not shown) may be required in order to inhibit fluid communication between the interior space (52) and the exterior (54) of the glass unit (22) other than through the pressure equalization conduit (28).

In other embodiments in which the spacer (22) and/or the glass unit (20) may otherwise be somewhat permeable to fluids, the glass unit (20) may be comprised of a sealing material which may be applied to the spacer (22) and/or to the interfaces between the spacer (22) and the glass panes (24, 26). The sealing material may reduce the permeability of the material of the spacer (22) and/or of flaws and imperfections in the glass unit (20) to fluids.

The sealing material may be comprised of any suitable material or combination of materials. In some embodiments, the sealing material may be a liquid material which may be applied as a coating to surfaces of the spacer (22) such as the front side (42), the back side (44), the interior perimeter edge (46) and the exterior perimeter edge (48), and/or to the perimeter (40) of the glass unit (20). In some embodiments, the sealing material may be a solid material which may be applied around the perimeter (40) of the glass unit (20).

In the first exemplary embodiment, the glass unit (20) is comprised of a solid material such as a metal foil (108) which is applied around the perimeter (40) of the glass unit (20) as a sealing material. A compressible material, such as a compressible foam tape (not shown), may optionally be applied to the corners of the glass unit (20) before applying the metal foil (108) in order to accommodate differential expansion and contraction of the metal foil (108) relative to the spacer (22), and a bead of butyl or some other suitable sealant (not shown) may optionally be applied to the edges of the metal foil (108) in order to minimize water vapour transmission between the metal foil (108) and the glass panes (24, 26).

Referring to FIGS. 1-6, in the first exemplary embodiment, the glass unit (20) is comprised of four intermediate layers (30) contained within the interior space (52) of the glass unit (20), wherein the four intermediate layers (30) are all film layers which are constructed of a film material, and is comprised of four floating suspension systems (32) which are adapted specifically for use with the film layers. In the first exemplary embodiment, each of the four floating suspension systems (32) is associated with one of the four intermediate layers (30), so that each intermediate layer (30) has its own floating suspension system (32).

In other embodiments, the glass unit (20) may be comprised of fewer than or greater than four intermediate layers (30), or may not include any intermediate layers (30).

Each of the intermediate layers (30) has a perimeter (110). The intermediate layers (30) are supported by the spacer (22) with the floating suspension systems (32) so that the intermediate layers (30) are in a spaced-apart parallel relationship with the front glass pane (24) and the back glass pane (26), and so that the intermediate layers (30) are capable of moving biaxially within the interior space (52) of the glass unit (20).

Figure 4:
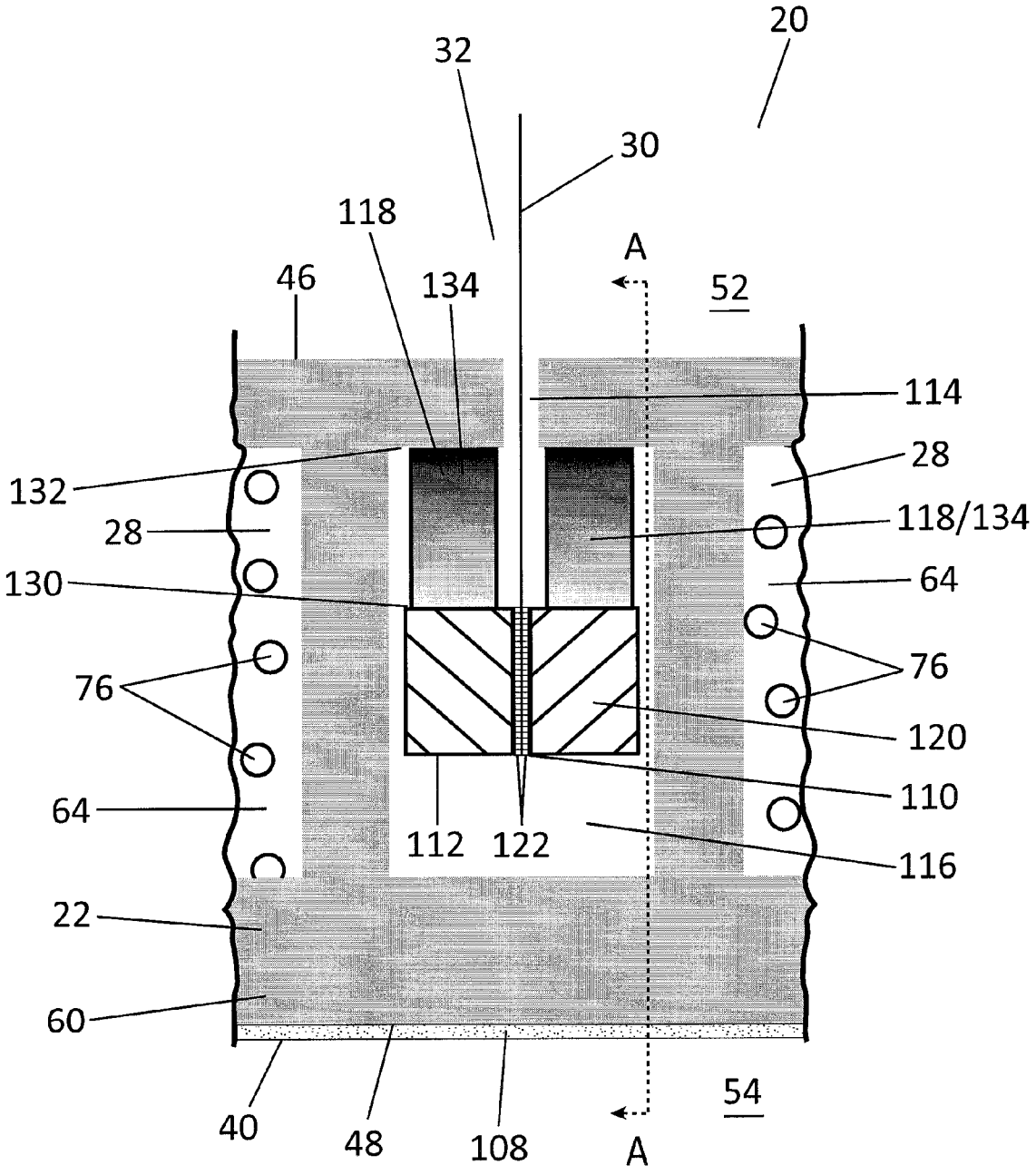
FIG. 4 is a schematic isolated side section view of an exemplary embodiment of a floating suspension system in the glass unit depicted in FIG. 1.

Referring to FIGS. 2-4, in the first exemplary embodiment, each of the floating suspension systems (32) is comprised of a film bar (112) which is attached to a film layer around the perimeter (110) of the film layer, a film slot (114) defined by the spacer (22) around the interior perimeter edge (46) of the spacer (22), for receiving the film layer therein, a suspension chamber (116) defined within the spacer (22) around the perimeter (40) of the glass unit (20) and in communication with the film slot (114), for receiving the film bar (112) therein, and a biasing mechanism (118) for biasing the film bar (112) away from the interior perimeter edge (46) of the spacer (22).

Figure 5A:
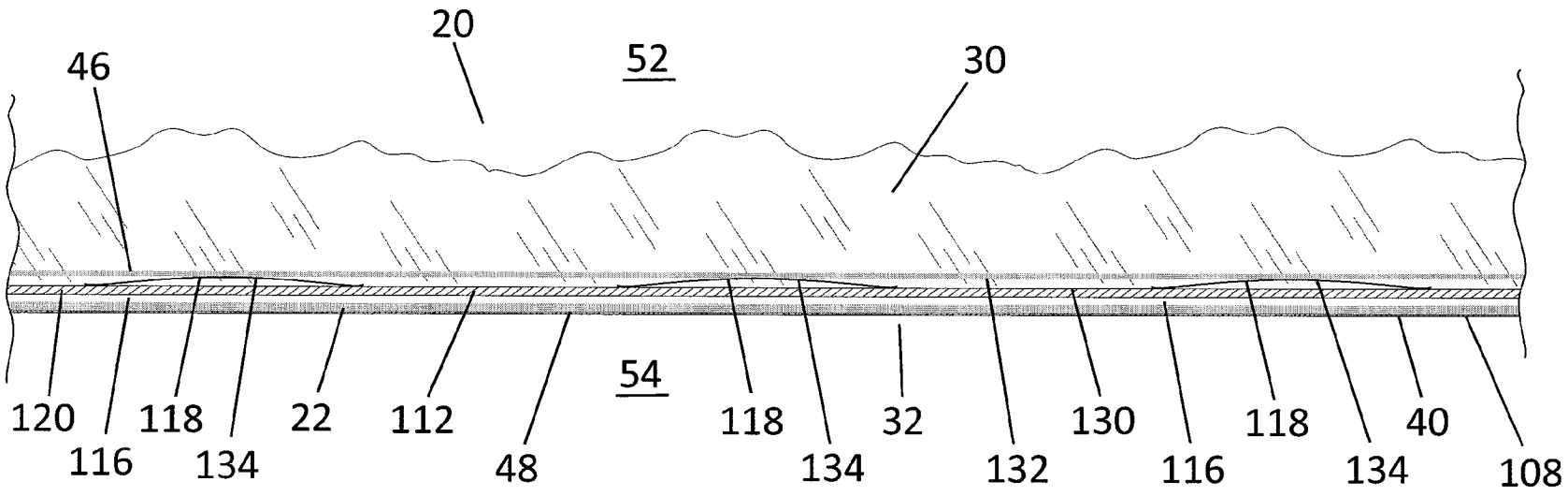
FIG. 5A is a schematic isolated front section view of a first configuration of the floating suspension system depicted in FIG. 4 taken along section line A-A in FIG. 4.
Figure 5B:
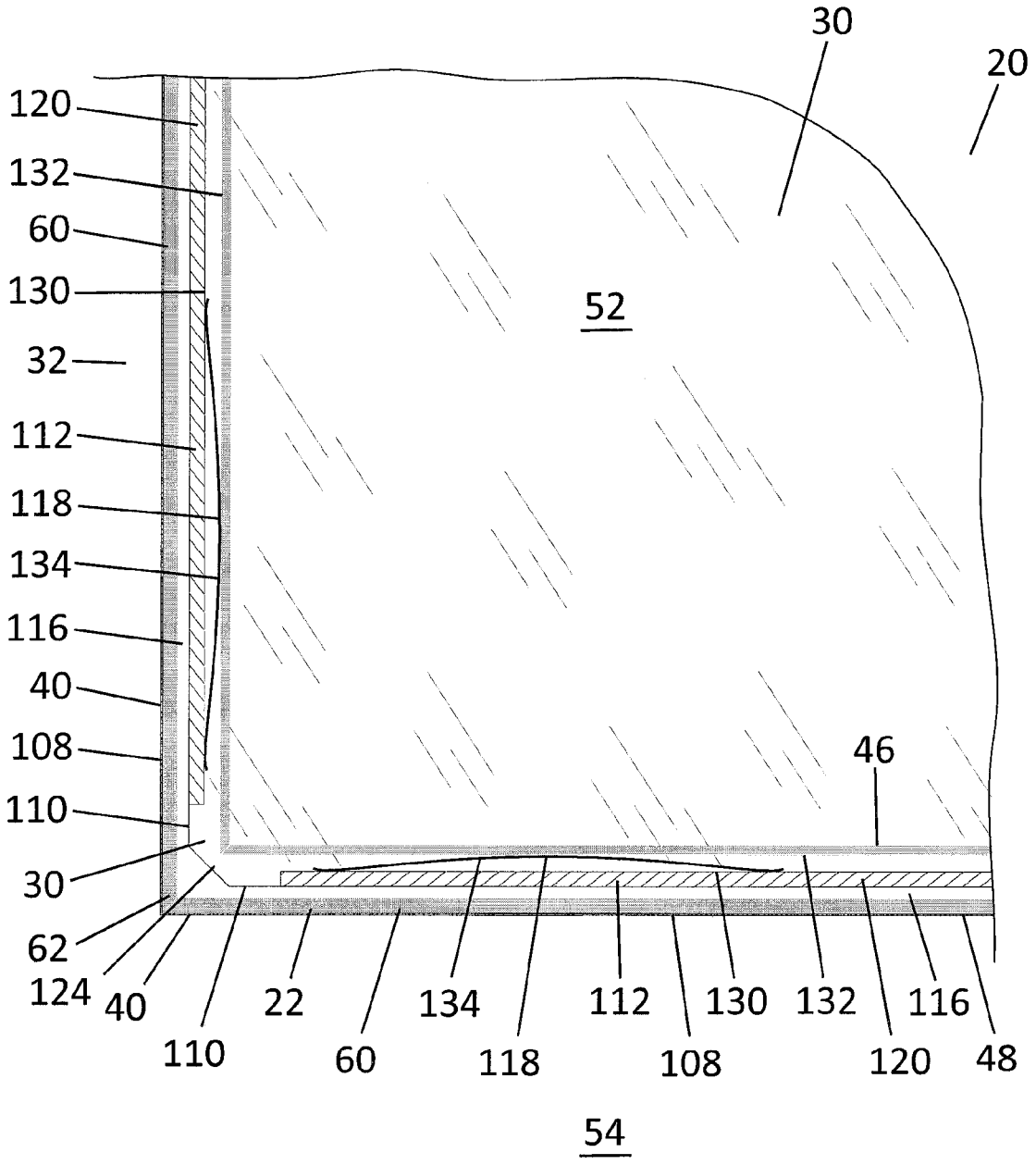
FIG. 5B is a schematic isolated front section view of a corner of the glass unit depicted in FIG. 1, providing a corner detail of the first configuration of the floating suspension system depicted in FIG. 5A.
Figure 6A:
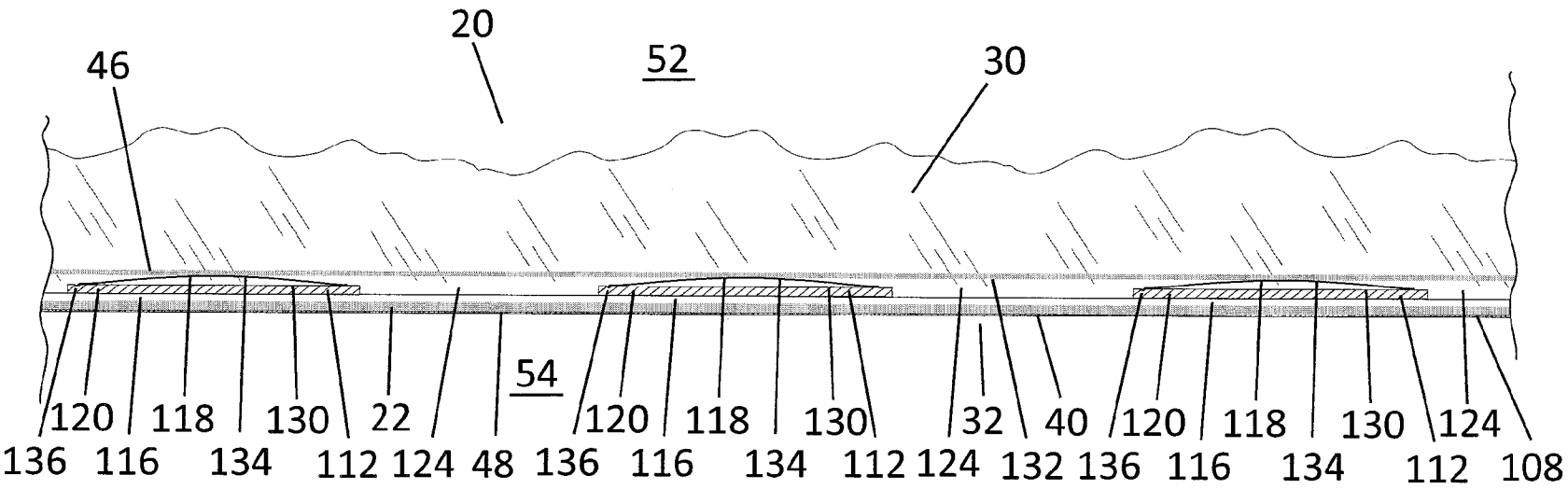
FIG. 6A is a schematic isolated front section view of a second configuration of the floating suspension system depicted in FIG. 4 taken along section line A-A in FIG. 4.
Figure 6B:
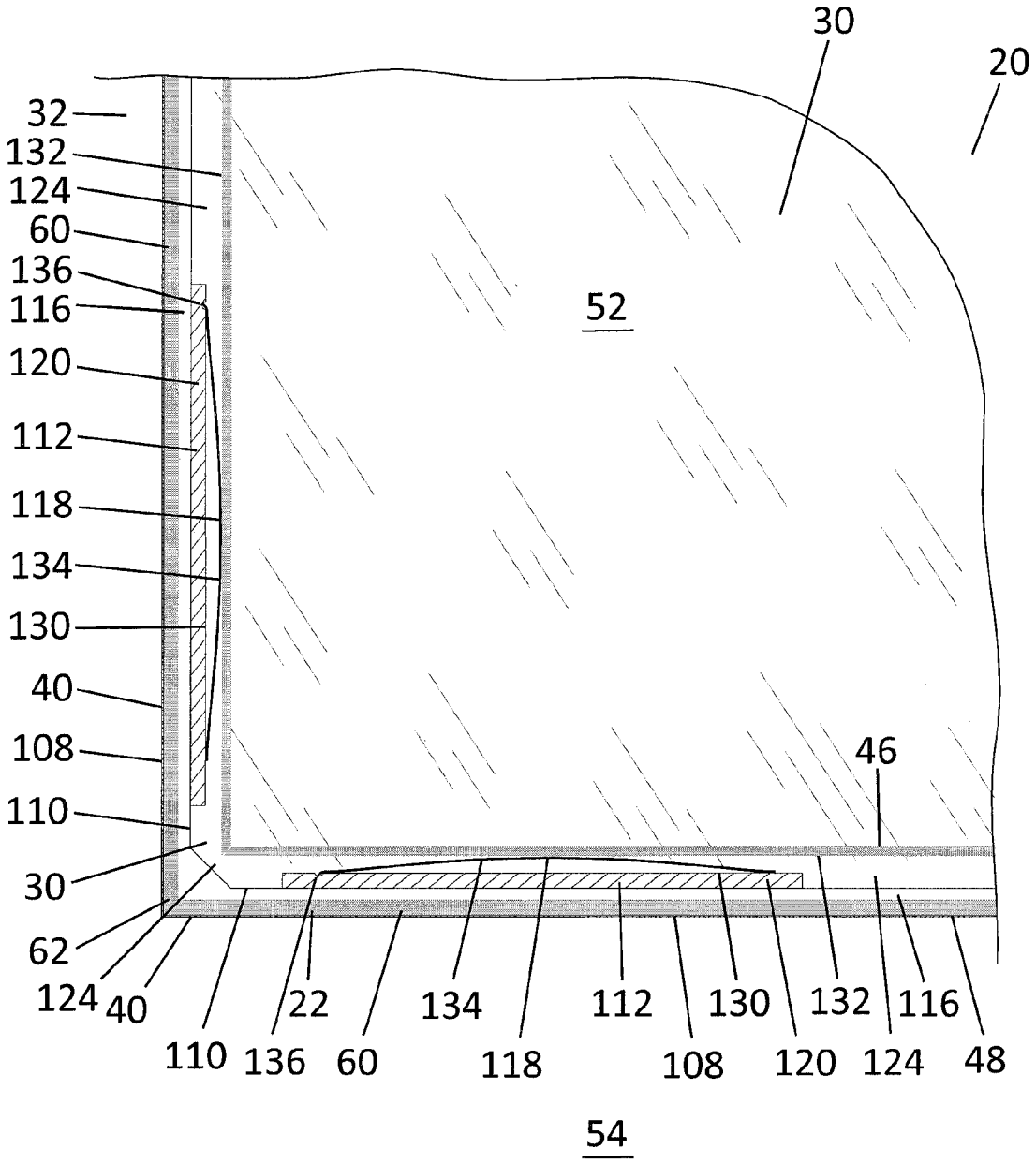
FIG. 6B is a schematic isolated front section view of a corner of the glass unit depicted in FIG. 1, providing a corner detail of the second configuration of the floating suspension system depicted in FIG. 6A.
Figure 7:
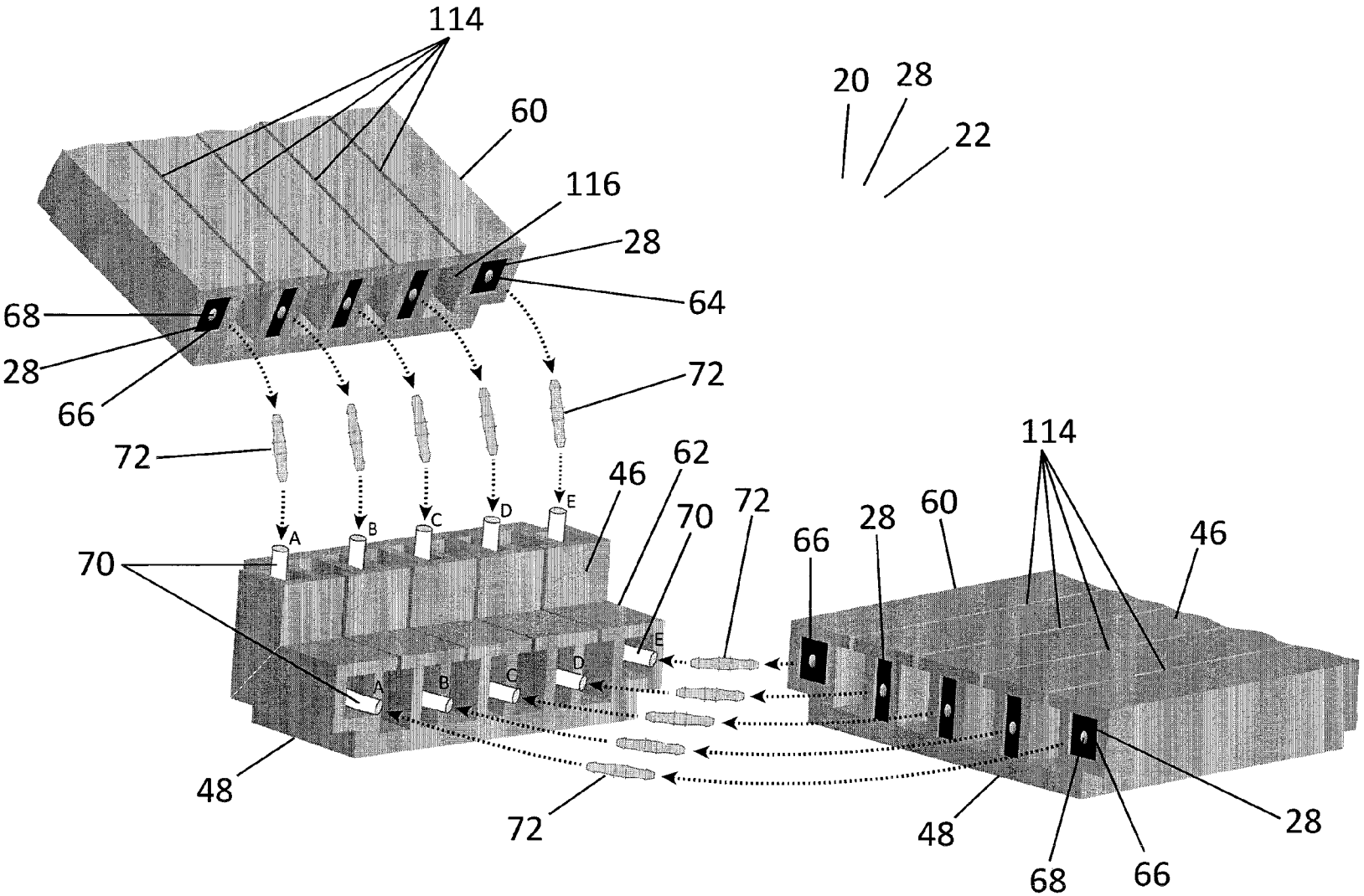
FIG. 7 is a schematic isolated exploded pictorial view of two spacer side members and a spacer corner member at a corner of the glass unit depicted in FIG. 1, showing the corner interconnection of five channels within the spacer.

FIGS. 5A and 5B depict a non-limiting first configuration of a floating suspension system (32) of the first exemplary embodiment. FIGS. 6A and 6B depict a non-limiting second configuration of a floating suspension system (32) of the first exemplary embodiment.

In the first configuration of the floating suspension system (32) of the first exemplary embodiment depicted in FIGS. 5A and 5B, the film bar (112) is comprised of four film bar members (120), wherein one film bar member (120) is associated with each of the four spacer side members (60).

In the second configuration of the floating suspension system (32) of the first exemplary embodiment depicted in FIGS. 6A and 6B, the film bar (112) is comprised of a plurality of film bar members (120) associated with each of the four spacer side members (60).

In both the first configuration and the second configuration of the floating suspension system (32) of the first exemplary embodiment, each film bar member (120) is in turn comprised of a pair of members which are attached to opposing sides of the film layer. In the first exemplary embodiment, the pair of members which make up a film bar member (120) are attached to the film layer with double sided tape (122), which may be supplemented with fasteners such as screws (not shown) spaced along the length of the film bar member (120) to provide additional attachment strength.

In both the first configuration and the second configuration of the floating suspension system (32) of the first exemplary embodiment, gaps (124) are provided between adjacent film bar members (120). In the first configuration, the gaps (124) are provided at the corners of the glass unit (20). In the second configuration, the gaps (124) are provided at the corners of the glass unit (20) and between adjacent film bar members (120) around the perimeter (40) of the glass unit (20).

In both the first configuration and the second configuration of the floating suspension system (32) of the first exemplary embodiment, the film slot (114) is sized to enable a fluid to pass between the spacer (22) and both sides of the film layer when the film layer is received within the film slot (114), and the suspension chamber (116) is configured to enable a fluid to pass around the perimeter (110) of the film layer when the film bar (112) is received within the suspension chamber (116). As a result, in the first exemplary embodiment, the floating suspension systems (32) are configured to provide a substantially equal pressure on both sides of the film layers and to allow for the circulation of a fluid around the film layers and within the interior space (52) of the glass unit (20).

In both the first configuration and the second configuration of the floating suspension system (32) of the first exemplary embodiment, each of the film bar members (120) is comprised of a film bar engagement surface (130), the suspension chamber (116) is comprised of a chamber engagement surface (132), and the biasing mechanism (118) is positioned in the suspension chamber (116) between the film bar engagement surface (130) and the chamber engagement surface (132).

In both the first configuration and the second configuration of the floating suspension system (32) of the first exemplary embodiment, the biasing mechanism (118) is comprised of a plurality of pairs of springs (134), such as leaf-type springs, which are arranged within the suspension chamber (116) around the perimeter (40) of the glass unit (20), wherein the springs (134) in a pair of springs (134) are positioned on opposite sides of the film layer.

In the first configuration of the floating suspension system (32) of the first exemplary embodiment, a plurality of pairs of springs (134) is associated with each of the film bar members (120), such that a plurality of pairs of springs (134) is spaced along the length of each of the film bar members (120).

In the second configuration of the floating suspension system (32) of the first exemplary embodiment, a single pair of springs (134) is associated with each of the film bar members (120), such that a separate pair of springs (134) is associated with each of the film bar members (120).

In both the first configuration and the second configuration of the floating suspension system (32) of the first exemplary embodiment, the springs (134) may be maintained in a desired position relative to their respective film bar members (120). As a non-limiting example, and as depicted in FIGS. 6A and 6B with respect to the second configuration, one end of each spring (134) may be retained in a notch (136) in the film bar engagement surface (130) of its respective film bar member (120), thereby enabling the other end of the spring (134) to move freely as the spring (134) flexes while maintaining the spring (134) in a desired position between the film bar engagement surface (130) and the chamber engagement surface (132).

In the first exemplary embodiment, the floating suspension systems (32) may therefore maintain the film layers in an evenly taut condition within the interior space (52) of the glass unit (20), since the biasing of the film bar members (120) away from the interior perimeter edge (46) of the spacer (22) will exert a biaxial tension force on the film layers.

The following considerations may apply to the design and construction of the floating suspension systems (32) of the first exemplary embodiment:

1. it may be desirable to attempt to match the thermal expansion characteristics of the film bar (112) and the film layers by matching the materials and/or by configuring the film bar (112) and the film layers to exhibit similar thermal expansion characteristics, in order to minimize differential expansion and contraction between the film bar (112) and the film layers which could cause the film layers to distort;
2. matching the thermal expansion characteristics of the film bar (112) and the film layers may be achieved in part by providing gaps (124) between adjacent film bar members (120), and/or by varying the number of film bar members (120), the lengths of the film bar members (120), and/or the lengths of the gaps (124) between adjacent film bar members (120);
3. similarly, it may be possible to limit the occurrence and severity of edge imperfections of the film layers due to varying forces and stresses along the edges of the film layers by varying the number of film bar members (120), the lengths of the film bar members (120), and/or the lengths of the gaps (124) between adjacent film bar members (120);
4. for some applications in which the materials comprising the film bar (112) and the film layers exhibit a similar thermal expansion coefficient, limiting the gap (124) length between adjacent film bar members (120) to a minimum gap (124) length may be desirable in order to minimize distortion of the film layers due to differential thermal expansion. The minimum gap (124) length may be determined having regard to the overall design and configuration of the glass unit (20), including the materials of the film bar members (120) and the film layers, the shape of the film bar members (120), the thickness of the film layers, and the overall configuration of the glass unit (20). For some applications, a preferred minimum gap (124) length may be about 75 millimeters. For some applications, the minimum gap (124) length may be less than 75 millimeters;

5. for some applications, limiting the gap (124) length between adjacent film bar members (120) to a maximum gap (124) length may be desirable in order to avoid distortion of the film layers due to varying forces and stresses along the edges of the film layers. The maximum gap (124) length may be determined having regard to the overall design and configuration of the glass unit (20), including the materials of the film bar members (120) and the film layers, the shape and length of the film bar members (120), the thickness of the film layers, and the overall configuration of the glass unit (20). For some applications, a preferred maximum gap (124) length may be about 200 millimeters. For some applications, the maximum gap (124) length may be greater than 200 millimeters;
6. for some applications, limiting the length of the film bar members (120) to a minimum length may be desirable in order to accommodate the biasing mechanisms (118) which are associated with the film bar members (120), and limiting the length of the film bar members (120) to a maximum length may be desirable in order to avoid distortion of the film layers due to differential thermal expansion. For some applications, the preferred lengths of film bar members (120) may be between about 75 millimeters and about 150 millimeters. For some applications, the lengths of film bar members (120) may be about 115 millimeters. For some applications, the lengths of film bar members (120) may be less than 75 millimeters. For some applications, the lengths of film bar members (120) may be greater than 150 millimeters;
7. for best results, it may be desirable to provide consistent dimensions for each of the film bar members (120), and to ensure that the film bar engagement surfaces (130) and their corresponding chamber engagement surfaces (132) are flat and parallel to each other;
8. for best results, it may be desirable to provide gaps (124) of reduced length between adjacent film bar members (120) at the corners of the glass unit (20). For example, for some applications, it may be desirable for the film bar members (120) at the corners of the glass unit (20) to extend to within about 25 millimeters of the corners of the film layer, so that the lengths of the gaps (124) at the corners of the glass unit (20) is less than about 50 millimeters; and
9. in order to minimize edge imperfections of the film layers further, it may be desirable to provide only limited clearance between the film bar members (120) and the sides of their respective suspension chambers (116), wherein the clearance is sufficient to facilitate movement of the film bar members (120) as the film layers expand and contract, but is limited to maintain the film layers centered within the suspension chambers (116) and the film slots (114). For some applications, a total clearance of no more than about 0.5 millimeters between the film bar members (120) and their respective suspension chambers (116), or about 0.25 millimeters per side, may be sufficient.

The first exemplary embodiment of the glass unit (20) may be assembled using several different methods.

In a non-limiting exemplary assembly method for the first exemplary embodiment:

1. the film layers are suspended in a spaced-apart parallel relationship and are stretched at a uniform biaxial tension which is sufficient to keep the film layers biaxially stretched without distortion;
2. a film bar (112) comprising a plurality of film bar members (120) is attached to each of the film layers around the perimeter (110) of the film layer;
3. pairs of springs (134) are attached to the film bar engagement surfaces (130) of each of the film bar members (120) as a biasing mechanism (118);
4. each spacer side member (60) is prepared for assembly by inserting a rubber plug (66) or a filter (88, 92) and a sealed rubber plug (74) in each of the channels (64) at one end of each of the spacer side members (60), substantially filling each of the channels (64) with a desiccant (76), and inserting a rubber plug (66) or a filter (88, 92) and a sealed rubber plug (74) in each of the channels (64) at the remaining open end of each of the spacer side members (60);
5. each spacer side member (60) is aligned with a side of the film layers so that the suspension chambers (116) can receive the film bar members (120) and so that the film slots (114) can receive the film layers;
6. the spacer side members (60) are moved toward each other to insert the film bar members (120) in the suspension chambers (116) until the ends of the spacer side members (60) are approximately close enough to enable the spacer corner members (62) to be connected with the spacer side members (60);
7. the spacer side members (60) are moved away from each other slightly biaxially in order to compress the springs (134) within the suspension chambers (116) and make the film layers taut;
8. the spacer corner members (62) are prepared for assembly by inserting connector tubes (70) in the channels (64);
9. the connectors (72) are connected between the connector holes (68) in the rubber plugs (66) in the spacer side members (60) and the connector tubes (70) in the spacer corner members (62);
10. the spacer side members (60) are connected together with the spacer corner members (62) with the film layers taut, in order to assemble the spacer (22);
11. the front glass pane (24) is attached to the front side (42) of the spacer (22) and the back glass pane (26) is attached to the back side (44) of the spacer (22);
12. the front seal (100) and the back seal (102) are applied within the front seal groove (104) and the back seal groove (106) respectively;
13. metal foil (108) is applied around the perimeter (40) of the glass unit (20) as a sealing material for the glass unit (20); and
14. the first end port tube (86) is attached to the first end port (84) to complete the assembly of the glass unit (20).

Referring to FIGS. 16-18, the second exemplary embodiment of the glass unit (20) is very similar to the first exemplary embodiment of the glass unit (20), and is also comprised of a spacer (22), a front glass pane (24), a back glass pane (26), a pressure equalization conduit (28), a plurality of intermediate layers (30), and a plurality of floating suspension systems for the intermediate layers (30).

A principal difference between the first exemplary embodiment depicted in FIGS. 1-15 and the second exemplary embodiment depicted in FIGS. 16-18 is that the four intermediate layers (30) in the second exemplary embodiment are glass lites which are constructed of a glass material.

Although the use of glass lites in the second exemplary embodiment instead of film layers results in some differences in the shape and configuration of the spacer (22) and in the design of the floating suspension systems (32), the overall design approach to the glass unit (20) is very similar in the first exemplary embodiment and the second exemplary embodiment. For example, the configuration of the pressure equalization conduit (28) in the second exemplary embodiment is very similar, if not identical to the configuration in the first exemplary embodiment.

In the description of the second exemplary configuration of the glass unit (20) which follows, only those features which are different from the first exemplary embodiment will be described in detail, and the same reference numbers which were used in the description of the first exemplary embodiment will be used to describe equivalent features in the second exemplary embodiment.

Referring to FIGS. 16-18, the exterior perimeter edge (48) of the spacer (22) in the second exemplary embodiment includes strengthening ribs (140) which provide additional support for the glass lites, which are much heavier than the film layers in the first exemplary embodiment.

In the second exemplary embodiment, as in the first exemplary embodiment, the glass unit (20) is comprised of a solid material such as a metal foil (108) which is applied around the perimeter (40) of the glass unit (20) as a sealing material. A compressible material, such as a compressible foam tape (not shown), may optionally be applied to the corners of the glass unit (20) before applying the metal foil (108) in order to accommodate differential expansion and contraction of the metal foil (108) relative to the spacer (22), and a bead of butyl or some other suitable sealant (not shown) may optionally be applied to the edges of the metal foil (108) in order to minimize water vapour transmission between the metal foil (108) and the glass panes (24, 26).

As a result, in the second exemplary embodiment, the exterior perimeter edge (48) of the spacer (22) is comprised of connecting members between the ends of the strengthening ribs (140) in order to provide a flat surface for the application of the metal foil to the perimeter (40) of the glass unit (20). Alternatively, in embodiments in which the glass unit (20) is comprised of a solid material as a sealing material, the strengthening ribs (140) may be omitted and additional support for the glass lites may be provided by shims or setting blocks positioned beneath the glass lites between the spacer (22) and the window frame (not shown) when the complete window (not shown) is assembled.

Referring to FIGS. 17-18, the floating suspension systems (32) in the second exemplary embodiment are not required to place the intermediate layers (30) in tension (since the glass lites are a rigid material in comparison with the film layers), but are still required to facilitate biaxial movement of the glass lites within the interior space (52) of the glass unit (20) in order to accommodate changes in dimension of the glass lites resulting from temperature changes and/or stresses experienced by the glass lites.

In the second exemplary embodiment, each of the floating suspension systems (32) is comprised of a lite pocket (142) defined by the spacer (22) around the interior perimeter edge (46) of the spacer (22), for receiving the perimeter (110) of a glass lite therein.

In the second exemplary embodiment, the lite pocket (142) is sized to enable a fluid to pass between the spacer (22) and both sides of the glass lite when the glass lite is received within the lite pocket (142), and is configured to enable a fluid to pass around the perimeter (110) of the glass lite when the glass lite is received within the lite pocket (142). As a result, in the second exemplary embodiment, the floating suspension systems (32) are configured to provide a substantially equal pressure on both sides of the glass lites and to allow for the circulation of a fluid around the glass lites and within the interior space (52) of the glass unit (20).

In the second exemplary embodiment, each of the floating suspension systems (32) is further comprised of a biasing mechanism (144) for biasing the perimeter (110) of a glass lite toward the interior perimeter edge (46) of the spacer (22), so that the glass lites are supported and cushioned within the interior space (52) of the glass unit (20).

In the second exemplary embodiment, the biasing mechanism (144) is comprised of a resilient material which is arranged within the lite pocket (142) around all or a portion of the perimeter of the glass unit (20). In the second exemplary embodiment, the resilient material is arranged within the lite pocket (142) with gaps to ensure that the biasing mechanism (144) will not interfere with the passage of a fluid around the perimeter (110) of the glass lite.

The second exemplary embodiment of the glass unit (20) may be assembled using several different methods.

In a non-limiting exemplary assembly method for the second exemplary embodiment:

1. the glass lites are supported in a spaced-apart parallel relationship;
2. each spacer side member (60) is prepared for assembly by inserting a rubber plug (66) or a filter (88, 92) and a sealed rubber plug (74) in each of the channels (64) at one end of each of the spacer side members (60), substantially filling each of the channels (64) with a desiccant (76), and inserting a rubber plug (66) or a filter (88, 92) and a sealed rubber plug (74) in each of the channels (64) at the remaining open end of each of the spacer side members (60);
3. the spacer side members (60) are moved toward the perimeters (110) of the glass lites in order to insert the perimeters (110) of the glass lites in the lite pockets (142), until the ends of the spacer side members (60) are close enough to enable the spacer corner members (62) to be connected with the spacer side members (60);
4. the spacer corner members (62) are prepared for assembly by inserting connector tubes (70) in the channels (64);
5. the connectors (72) are connected between the connector holes (68) in the rubber plugs (66) in the spacer side members (60) and the connector tubes (70) in the spacer corner members (62);
6. the spacer side members (60) are connected together with the spacer corner members (62);
7. the front glass pane (24) is attached to the front side (42) of the spacer (22) and the back glass pane (26) is attached to the back side (44) of the spacer (22);
8. the front seal (100) and the back seal (102) are applied within the front seal groove (104) and the back seal groove (106) respectively;

9. metal foil (108) is applied around the perimeter (40) of the glass unit (20) as a sealing material for the glass unit (20); and
10. the first end port tube (86) is attached to the first end port (84) to complete the assembly of the glass unit (20).

A glass unit (20) within the scope of the invention may be combined with a window frame (not shown) in order to provide a complete window (not shown) which can be used for a wide range of residential and commercial applications. In the first exemplary embodiment and the second exemplary embodiment, the glass unit (20) of the invention is configured to perform independently of the window frame and therefore can be used with any window frame which is sized to be compatible with the glass unit (20).

The features offered by various embodiments of the invention include the following:

1. the interior space (52) of the glass unit (20) is configured to contain air, and thus does not rely upon the use and sealing within the interior space (52) of high thermal resistance gases such as argon, krypton, xenon, etc., which tend to leak from glass units over time;
2. the glass unit (52) is easily scalable and variable by varying the width and configuration of the spacer (22), and can thus be configured to achieve a wide range of performance characteristics (u-value, shading coefficient, solar heat gain, visible light transmission, sound attenuation, etc.) by varying parameters such as the number, type and thickness of intermediate layers (30), by using specially engineered intermediate layers (30) such as vacuum glass lites, by varying the gap between intermediate layers (30), by applying suitable coatings to the intermediate layers (30), etc.;
3. the glass unit (20) can be effectively configured to provide a relatively wide glass unit (20) while achieving desirable performance characteristics, thus allowing the glass unit (20) to be incorporated into a relatively wide window frame which can provide a relatively large thermal break. As a result, a complete window including the glass unit (20) and the relatively wide window frame can potentially achieve a very desirable overall thermal resistance value;
4. the glass unit (20) is pressure compensated, with the result that the pressure differentials which occur within conventional multi-pane sealed glass units (i.e., triple, quadruple, quintuple pane glass units) can be reduced. The reduction of pressure differentials is further assisted by configuring the floating suspension systems (32) so that air within the interior space (52) of the glass unit (20) can pass around the intermediate layers (30) and circulate throughout the interior space (52), thereby effectively pressure balancing the intermediate layers (30);
5. the pressure compensation and floating suspension systems (32) of the glass unit (20) allow for the use of relatively thin, light and/or fragile intermediate layers (30), such as film layers, thin glass lites, vacuum glass lites, etc., since the risk of failure or breakage of the intermediate layers (30) due to the stresses experienced by the intermediate layers (30) is reduced;
6. the floating suspension systems (32) of the glass unit (20) allow the intermediate layers (30) to expand or contract with changing temperatures, without exposing the intermediate layers (30) to high stresses due to their expansion and contraction as would occur if the intermediate layers (30) were fixed within the glass unit (20);
7. in embodiments of the invention which include film layers as intermediate layers (30), the film layers are maintained taut biaxially by exerting relatively gentle forces on the film layers via the biasing mechanism (118). The application of relatively gentle stresses on the film layers helps to preserve the elasticity of the film layers and to prolong the service life of the film layers. In addition, as the film layers stretch and relax due to changing temperatures or other environmental conditions, the biasing mechanism (188) can adapt to exert greater or lesser forces on the film layers in order to maintain the film layers taut biaxially over a wide range of conditions without permanently deforming the film layers;
8. in embodiments of the invention which include film layers as intermediate layers (30), the film bars (112) help to distribute the forces which are exerted on the film layers by the biasing mechanism (118) evenly along both axes of the film layers, thereby avoiding point loading on the film layers and reducing distortion and/or deformation of the film layers due to point loading;
9. the use of relatively light intermediate layers (30) in the glass unit (20) potentially enables the performance-to-weight ratio of the glass unit (20) to be increased, thereby enabling increased performance for a desired weight of the glass unit (20), or a lower weight for a desired performance of the glass unit (20);
10. the pressure equalization conduit (28) in the glass unit (20) is configured to provide a relatively long single pathway for the transfer of fluids between the exterior (54) of the glass unit (20) and the interior space (52) of the glass unit (20), thereby providing increased opportunity for moisture to be removed from the fluids by the desiccant (76) contained within the pressure equalization conduit (28);
11. the relatively long single pathway provided by the pressure equalization conduit (28) potentially provides a very long service life for the glass unit (20), without the need to service the glass unit (20). As a desiccant (76) becomes saturated and thus spent, the moisture absorbing/adsorbing capacity of the desiccant (76) is reduced. In the glass unit (20) of the invention, by requiring all fluids to pass through the entire length of the pressure equalization conduit (28), all fluids will be exposed to all of the desiccant (76) which is contained within the pressure equalization conduit (28). As a result, if a portion of the desiccant (76) becomes saturated and spent, the fluids can be exposed to other desiccant (76) along the length of the pressure equalization conduit (28). In addition, by requiring all fluids to pass through the entire length of the pressure equalization conduit (28), there is a reduced likelihood that the desiccant (76) immediately adjacent to the second end port (90) will become saturated and spent, a reduced likelihood that moisture will be allowed to enter the interior space (52) of the glass unit, and a reduced likelihood of corrosion or other damage due to moisture to coatings which may be applied to the intermediate layers (30);
12. the pressure balancing of the glass unit (20) and the design and configuration of the spacer (22) in the glass unit (20) potentially facilitates the use of only the front seal (100) and the back seal (102) to seal the glass unit (20), regardless of the number of intermediate layers (30) which are included in the glass unit (20). This feature reduces the cost of the glass unit (20) by avoiding multiple seals, and reduces the risk of seal failure due to the complexity of multiple seals and/or due to pressure differentials across the seals (100, 102); and 13. the design and configuration of the spacer (22) allows the spacer (22) to be constructed of a material or materials which provides desirable strength, flexibility, thermal resistance and coefficient of expansion properties. As a non-limiting example, the spacer (22) in the exemplary embodiments is constructed of fiberglass. Fiberglass generally exhibits a strength and flexibility which renders it suitable for absorbing dynamic forces such as wind forces which may be exerted on the glass unit (20), thereby potentially reducing the stresses which are applied between the spacer (22) and the glass panes (24, 26) as a result of such forces, and potentially reducing the stresses on the seals (100, 102). Fiberglass also generally exhibits a relatively high thermal resistance and has a coefficient of expansion which is generally comparable to glass.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane; and (d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, wherein the pressure equalization conduit is continuous between the first end port and the second end Port so that a fluid can transfer through the pressure equalization conduit between the exterior of the glass unit and the interior space of the glass unit only at the first end port and the second end port, wherein the pressure equalization conduit is filled with a desiccant, and wherein the pressure equalization conduit extends within the spacer more than once around the perimeter of the glass unit so that the fluid is required to pass through the pressure equalization conduit more than once around the perimeter of the glass unit in order to transfer between the exterior of the glass unit and the interior space of the glass unit.

2. The glass unit as claimed in claim 1 wherein the first end port of the pressure equalization conduit is comprised of a single aperture extending between the pressure equalization conduit and the exterior of the glass unit.

3. The glass unit as claimed in claim 1 wherein the second end port of the pressure equalization conduit is comprised of a single aperture extending between the pressure equalization conduit and the interior space of the glass unit.

4. The glass unit as claimed in claim 1 wherein the second end port of the pressure equalization conduit is comprised of a plurality of apertures extending between the pressure equalization conduit and the interior space of the glass unit.

5. The glass unit as claimed in claim 1 wherein the spacer defines therein a plurality of channels extending around the perimeter of the glass unit which are connected together in a series configuration, and wherein the plurality of channels provide the pressure equalization conduit.

6. The glass unit as claimed in claim 5 wherein the spacer is comprised of a crossover section for connecting the plurality of channels together in the series configuration.

7. The glass unit as claimed in claim 1, further comprising a front seal around the perimeter of the glass unit for providing a seal between the spacer and the front glass pane, and further comprising a back seal around the perimeter of the glass unit for providing a seal between the spacer and the back glass pane.

8. The glass unit as claimed in claim 1, further comprising:

(a) an intermediate layer contained within the interior space of the glass unit, wherein the intermediate layer has a perimeter; and (b) a floating suspension system associated with the intermediate layer and the spacer, wherein the perimeter of the intermediate layer is supported by the spacer with the floating suspension system so that the intermediate layer is in a spaced-apart parallel relationship with the front glass pane and the back glass pane and so that the intermediate layer is capable of moving biaxially within the interior space of the glass unit.

9. The glass unit as claimed in claim 8 wherein the intermediate layer is a film layer and wherein the floating suspension system is comprised of:

(a) a film bar attached to the film layer around the perimeter of the film layer;

(b) a film slot defined by the spacer around the interior perimeter edge of the spacer, for receiving the film layer therein;

(c) a suspension chamber defined within the spacer around the perimeter of the glass unit, wherein the suspension chamber is in communication with the film slot, for receiving the film bar therein; and (d) a biasing mechanism for biasing the film bar away from the interior perimeter edge of the spacer.

10. The glass unit as claimed in claim 9 wherein the film bar is comprised of a plurality of film bar members arranged around the perimeter of the film layer.

11. The glass unit as claimed in claim 10 wherein the plurality of film bar members are arranged around the perimeter of the film layer such that gaps are provided between adjacent film bar members.

12. The glass unit as claimed in claim 8 wherein the intermediate layer is a glass lite and wherein the floating suspension system is comprised of a lite pocket defined by the spacer around the interior perimeter edge of the spacer, for receiving the perimeter of the glass lite therein.

13. The glass unit as claimed in claim 12 wherein the floating suspension system is configured to allow a fluid contained within the interior space of the glass unit to pass around the perimeter of the glass lite by passing through the lite pocket.

14. The glass unit as claimed in claim 12 wherein the floating suspension system is further comprised of a biasing mechanism for biasing the perimeter of the glass lite toward the interior perimeter edge of the spacer.

15. The glass unit as claimed in claim 14 wherein the biasing mechanism is comprised of a resilient material arranged within the lite pocket around at least a portion of the perimeter of the glass unit.

16. The glass unit as claimed in claim 9 wherein the floating suspension system is configured to allow a fluid contained within the interior space of the glass unit to pass around the perimeter of the film layer by passing through the film slot and the suspension chamber.

17. The glass unit as claimed in claim 9 wherein the film bar is comprised of a film bar engagement surface, wherein the suspension chamber is comprised of a chamber engagement surface, and wherein the biasing mechanism is positioned in the suspension chamber between the film bar engagement surface and the chamber engagement surface.

18. The glass unit as claimed in claim 17 wherein the biasing mechanism is comprised of a plurality of springs arranged within the suspension chamber around the perimeter of the glass unit.

19. The glass unit as claimed in claim 1, further comprising:

(a) a plurality of intermediate layers contained within the interior space of the glass unit, wherein each of the intermediate layers has a perimeter;

(b) a plurality of floating suspension systems, each associated with one of the plurality of intermediate layers and the spacer, wherein the perimeters of the intermediate layers are supported by the spacer with the floating suspension systems so that the intermediate layers are in a spaced-apart parallel relationship with the front glass pane and the back glass pane and so that the intermediate layers are capable of moving biaxially within the interior space of the glass unit.

20. The glass unit as claimed in claim 19 wherein at least one of the plurality of intermediate layers is a glass lite and wherein each of the floating suspension systems associated with one of the glass lites is comprised of a lite pocket defined by the spacer around the interior perimeter edge of the spacer, for receiving the perimeter of the one of the glass lites therein.

21. The glass unit as claimed in claim 20 wherein each of the floating suspension systems associated with one of the glass lites is configured to allow a fluid contained within the interior space of the glass unit to pass around the perimeter of the associated glass lite by passing through the lite pocket.

22. The glass unit as claimed in claim 20 wherein each of the floating suspension systems associated with one of the glass lites is further comprised of a biasing mechanism for biasing the perimeter of the associated glass lite toward the interior perimeter edge of the spacer.

23. The glass unit as claimed in claim 22 wherein the biasing mechanism is comprised of a resilient material arranged within the lite pocket around at least a portion of the perimeter of the glass unit.

24. The glass unit as claimed in claim 19 wherein at least one of the plurality of intermediate layers is a film layer and wherein each of the floating suspension systems associated with one of the film layers is comprised of:

(a) a film bar attached to one of the film layers around the perimeter of the one of the film layers;

(b) a film slot defined by the spacer around the interior perimeter edge of the spacer, for receiving the one of the film layers therein;

(c) a suspension chamber defined within the spacer around the perimeter of the glass unit, wherein the suspension chamber is in communication with the film slot, for receiving the film bar therein; and (d) a biasing mechanism for biasing the film bar away from the interior perimeter edge of the spacer.

25. The glass unit as claimed in claim 24 wherein each of the floating suspension systems associated with one of the film layers is configured to allow a fluid contained within the interior space of the glass unit to pass around the perimeter of the associated film layer by passing through the film slot and the suspension chamber.

26. The glass unit as claimed in claim 24 wherein the film bar is comprised of a film bar engagement surface, wherein the suspension chamber is comprised of a chamber engagement surface, and wherein the biasing mechanism is positioned in the suspension chamber between the film bar engagement surface and the chamber engagement surface.

27. The glass unit as claimed in claim 26 wherein the biasing mechanism is comprised of a plurality of springs arranged within the suspension chamber around the perimeter of the glass unit.

28. The glass unit as claimed in claim 24 wherein the film bar is comprised of a plurality of film bar members arranged around the perimeter of the film layer.

29. The glass unit as claimed in claim 28 wherein the plurality of film bar members are arranged around the perimeter of the film layer such that gaps are provided between adjacent film bar members.

30. The glass unit as claimed in claim 1 wherein the perimeter of the glass unit is a rectangular perimeter, wherein the spacer is comprised of four spacer side members which are connected together to define the rectangular perimeter.

31. The glass unit as claimed in claim 30 wherein the spacer is further comprised of four spacer corner members for connecting the spacer side members together.

32. The glass unit as claimed in claim 31 wherein the spacer defines a plurality of channels extending around the perimeter of the glass unit which are connected together in a series configuration, and wherein the plurality of channels provide the pressure equalization conduit.

33. The glass unit as claimed in claim 32 wherein the spacer is further comprised of a crossover section for connecting the plurality of channels together in the series configuration, and wherein one of the spacer corner members is comprised of the crossover section.

34. The glass unit as claimed in claim 30, further comprising a front seal around the perimeter of the glass unit for providing a seal between the spacer and the front glass pane, and further comprising a back seal around the perimeter of the glass unit for providing a seal between the spacer and the back glass pane.

35. The glass unit as claimed in claim 1, further comprising:

(e) one or more intermediate layers contained within the interior space of the glass unit, wherein each of the one or more intermediate layers has a perimeter; and (f) one or more floating suspension systems, each associated with one intermediate layer and the spacer, wherein the perimeters of the one or more intermediate layers are supported by the spacer with the one or more floating suspension systems so that the one or more intermediate layers are in a spaced-apart parallel relationship with the front glass pane and the back glass pane and so that the one or more intermediate layers are capable of moving biaxially within the interior space of the glass unit.

36. The glass unit as claimed in claim 35, further comprising a front seal around the perimeter of the glass unit for providing a seal between the spacer and the front glass pane, and further comprising a back seal around the perimeter of the glass unit for providing a seal between the spacer and the back glass pane.

37. The glass unit as claimed in claim 35 wherein at least one intermediate layer is a film layer and wherein the at least one floating suspension system associated with the at least one film layer is comprised of:

(a) a film bar attached to the film layer around the perimeter of the film layer;

(b) a film slot defined by the spacer around the interior perimeter edge of the spacer, for receiving the film layer therein;

(c) a suspension chamber defined within the spacer around the perimeter of the glass unit, wherein the suspension chamber is in communication with the film slot, for receiving the film bar therein; and (d) a biasing mechanism for biasing the film bar away from the interior perimeter edge of the spacer.

38. The glass unit as claimed in claim 37 wherein the at least one floating suspension system associated with the at least one film layer is configured to allow a fluid contained within the interior space of the glass unit to pass around the perimeter of the film layer by passing through the film slot and the suspension chamber.

39. The glass unit as claimed in claim 37 wherein the film bar is comprised of a film bar engagement surface, wherein the suspension chamber is comprised of a chamber engagement surface, and wherein the biasing mechanism is positioned in the suspension chamber between the film bar engagement surface and the chamber engagement surface.

40. The glass unit as claimed in claim 39 wherein the biasing mechanism is comprised of a plurality of springs arranged within the suspension chamber around the perimeter of the glass unit.

41. The glass unit as claimed in claim 37 wherein the film bar is comprised of a plurality of film bar members arranged around the perimeter of the film layer.

42. The glass unit as claimed in claim 41 wherein the plurality of film bar members are arranged around the perimeter of the film layer such that gaps are provided between adjacent film bar members.

43. The glass unit as claimed in claim 35 wherein at least one intermediate layer is a glass lite and wherein the at least one floating suspension system associated with the at least one glass lite is comprised of a lite pocket defined by the spacer around the interior perimeter edge of the spacer, for receiving the perimeter of the glass lite therein.

44. The glass unit as claimed in claim 43 wherein the at least one floating suspension system associated with the at least one glass lite is configured to allow a fluid contained within the interior space of the glass unit to pass around the perimeter of the glass lite by passing through the lite pocket.

45. The glass unit as claimed in claim 43 wherein the at least one floating suspension system associated with the at least one glass lite is further comprised of a biasing mechanism for biasing the perimeter of the associated glass lite toward the interior perimeter edge of the spacer.

46. The glass unit as claimed in claim 45 wherein the biasing mechanism is comprised of a resilient material arranged within the lite pocket around at least a portion of the perimeter of the glass unit.

47. A glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane;

(d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, wherein the pressure equalization conduit is continuous between the first end port and the second end port so that a fluid can transfer through the pressure equalization conduit between the exterior of the glass unit and the interior space of the glass unit only at the first end port and the second end port, and wherein the pressure equalization conduit is filled with a desiccant;

(e) an intermediate layer contained within the interior space of the glass unit, wherein the intermediate layer has a perimeter; and (f) a floating suspension system associated with the intermediate layer and the spacer, wherein the perimeter of the intermediate layer is supported by the spacer with the floating suspension system so that the intermediate layer is in a spaced-apart parallel relationship with the front glass pane and the back glass pane and so that the intermediate layer is capable of moving biaxially within the interior space of the glass unit, wherein the intermediate layer is a glass lite and wherein the floating suspension system is comprised of a lite pocket defined by the spacer around the interior perimeter edge of the spacer, for receiving the perimeter of the glass lite therein.

48. The glass unit as claimed in claim 47 wherein the floating suspension system is configured to allow a fluid contained within the interior space of the glass unit to pass around the perimeter of the glass lite by passing through the lite pocket.

49. The glass unit as claimed in claim 47 wherein the floating suspension system is further comprised of a biasing mechanism for biasing the perimeter of the glass lite toward the interior perimeter edge of the spacer.

50. The glass unit as claimed in claim 49 wherein the biasing mechanism is comprised of a resilient material arranged within the lite pocket around at least a portion of the perimeter of the glass unit.

51. A glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane;

(d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, wherein the pressure equalization conduit is continuous between the first end port and the second end port so that a fluid can transfer through the pressure equalization conduit between the exterior of the glass unit and the interior space of the glass unit only at the first end port and the second end port, and wherein the pressure equalization conduit is filled with a desiccant;

(e) a plurality of intermediate layers contained within the interior space of the glass unit, wherein each of the intermediate layers has a perimeter; and (f) a plurality of floating suspension systems, each associated with one of the plurality of intermediate layers and the spacer, wherein the perimeters of the intermediate layers are supported by the spacer with the floating suspension systems so that the intermediate layers are in a spaced-apart parallel relationship with the front glass pane and the back glass pane and so that the intermediate layers are capable of moving biaxially within the interior space of the glass unit, wherein at least one of the plurality of intermediate layers is a glass lite and wherein each of the floating suspension systems associated with one of the glass lites is comprised of a lite pocket defined by the spacer around the interior perimeter edge of the spacer, for receiving the perimeter of the one of the glass lites therein.

52. The glass unit as claimed in claim 51 wherein each of the floating suspension systems associated with one of the glass lites is configured to allow a fluid contained within the interior space of the glass unit to pass around the perimeter of the associated glass lite by passing through the lite pocket.

53. The glass unit as claimed in claim 51 wherein each of the floating suspension systems associated with one of the glass lites is further comprised of a biasing mechanism for biasing the perimeter of the associated glass lite toward the interior perimeter edge of the spacer.

54. The glass unit as claimed in claim 53 wherein the biasing mechanism is comprised of a resilient material arranged within the lite pocket around at least a portion of the perimeter of the glass unit.

55. A glass unit comprising:

(a) a spacer defining a perimeter of the glass unit, wherein the spacer has a front side, a back side, an interior perimeter edge and an exterior perimeter edge;

(b) a front glass pane attached to the front side of the spacer;

(c) a back glass pane attached to the back side of the spacer, wherein the front glass pane and the back glass pane are maintained by the spacer in a spaced-apart parallel relationship which defines an interior space of the glass unit between the front glass pane and the back glass pane;

(d) a pressure equalization conduit defined by and within the spacer, wherein the pressure equalization conduit has a first end and a second end, wherein the pressure equalization conduit is in fluid communication with an exterior of the glass unit at a first end port which is adjacent to the first end of the pressure equalization conduit, wherein the pressure equalization conduit is in fluid communication with the interior space of the glass unit at a second end port which is adjacent to the second end of the pressure equalization conduit, and wherein the pressure equalization conduit is filled with a desiccant;

(e) one or more intermediate layers contained within the interior space of the glass unit, wherein each of the one or more intermediate layers has a perimeter; and (f) one or more floating suspension systems, each associated with one intermediate layer and the spacer, wherein the perimeters of the one or more intermediate layers are supported by the spacer with the one or more floating suspension systems so that the one or more intermediate layers are in a spaced-apart parallel relationship with the front glass pane and the back glass pane and so that the one or more intermediate layers are capable of moving biaxially within the interior space of the glass unit, wherein at least one intermediate layer is a glass lite and wherein the at least one floating suspension system associated with the at least one glass lite is comprised of a lite pocket defined by the spacer around the interior perimeter edge of the spacer, for receiving the perimeter of the glass lite therein.

56. The glass unit as claimed in claim 55 wherein the at least one floating suspension system associated with the at least one glass lite is configured to allow a fluid contained within the interior space of the glass unit to pass around the perimeter of the glass lite by passing through the lite pocket.

57. The glass unit as claimed in claim 55 wherein the at least one floating suspension system associated with the at least one glass lite is further comprised of a biasing mechanism for biasing the perimeter of the associated glass lite toward the interior perimeter edge of the spacer.

58. The glass unit as claimed in claim 57 wherein the biasing mechanism is comprised of a resilient material arranged within the lite pocket around at least a portion of the perimeter of the glass unit.

59. The glass unit as claimed in claim 55 wherein the pressure equalization conduit is continuous between the first end port and the second end port so that a fluid can transfer through the pressure equalization conduit between the exterior of the glass unit and the interior space of the glass unit only at the first end port and the second end port.

60. The glass unit as claimed in claim 59 wherein the first end port of the pressure equalization conduit is comprised of a single aperture extending between the pressure equalization conduit and the exterior of the glass unit.

61. The glass unit as claimed in claim 59 wherein the second end port of the pressure equalization conduit is comprised of a single aperture extending between the pressure equalization conduit and the interior space of the glass unit.

62. The glass unit as claimed in claim 59 wherein the second end port of the pressure equalization conduit is comprised of a plurality of apertures extending between the pressure equalization conduit and the interior space of the glass unit.

63. The glass unit as claimed in claim 59 wherein the pressure equalization conduit extends within the spacer around at least a portion of the perimeter of the glass unit.

64. The glass unit as claimed in claim 59 wherein the pressure equalization conduit extends within the spacer at least once around the perimeter of the glass unit.

65. The glass unit as claimed in claim 59 wherein the pressure equalization conduit extends within the spacer more than once around the perimeter of the glass unit so that the fluid is required to pass through the pressure equalization conduit more than once around the perimeter of the glass unit in order to transfer between the exterior of the glass unit and the interior space of the glass unit.

66. The glass unit as claimed in claim 65 wherein the spacer defines therein a plurality of channels extending around the perimeter of the glass unit which are connected together in a series configuration, and wherein the plurality of channels provide the pressure equalization conduit.

67. The glass unit as claimed in claim 66 wherein the spacer is comprised of a crossover section for connecting the plurality of channels together in the series configuration.

68. The glass unit as claimed in claim 59, further comprising a front seal around the perimeter of the glass unit for providing a seal between the spacer and the front glass pane, and further comprising a back seal around the perimeter of the glass unit for providing a seal between the spacer and the back glass pane.

* * * * *